US009505246B2

(12) United States Patent
Yoshida

(10) Patent No.: US 9,505,246 B2
(45) Date of Patent: Nov. 29, 2016

(54) CONTROL DEVICE

(71) Applicant: BROTHER KOGYO KABUSHIKI KAISHA, Nagoya-shi, Aichi-ken (JP)

(72) Inventor: Yasunari Yoshida, Aichi-ken (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/728,456

(22) Filed: Jun. 2, 2015

(65) Prior Publication Data

US 2015/0352873 A1 Dec. 10, 2015

(30) Foreign Application Priority Data

Jun. 4, 2014 (JP) ..... 2014-116216

(51) Int. Cl.
*B41J 19/14* (2006.01)
*B41J 2/21* (2006.01)

(52) U.S. Cl.
CPC ..... *B41J 19/147* (2013.01)

(58) Field of Classification Search
CPC ..... B41J 2/07; B41J 29/393; B41J 2/21; B41J 2/2103; B41J 2/2125; B41J 2/2132
See application file for complete search history.

(56) References Cited

U.S. PATENT DOCUMENTS 8,608,283 B1 * 12/2013 Phillips ..... B41J 2/1433 347/43
2002/0018090 A1 * 2/2002 Takazawa ..... B41J 2/115 347/19
2003/0001918 A1 * 1/2003 Tsuchiya ..... B41J 29/393 347/19
2004/0207685 A1 * 10/2004 Otsuki ..... B41J 19/147 347/40
2009/0040256 A1 * 2/2009 Baba ..... B41J 29/393 347/14
2010/0214336 A1 * 8/2010 Kuno ..... B41J 29/393 347/12
2011/0227982 A1 * 9/2011 Marumoto ..... B41J 2/2132 347/14

FOREIGN PATENT DOCUMENTS

JP 2002-292908 A 10/2002
JP 2009-292908 A 10/2002

* cited by examiner

*Primary Examiner* — Matthew Luu
*Assistant Examiner* — Patrick King
(74) *Attorney, Agent, or Firm* — Merchant & Gould P.C.

(57) ABSTRACT

A control device may create, in a case where one of a first printing method and a second printing method is selected, first print data for causing all of K groups of nozzles to discharge ink so as to perform a color printing of a target image, and create, in a case where the other of the first printing method and the second printing method is selected, second print data for causing (K−k) groups of nozzles to discharge ink so as to perform a color printing the target image, the (K−k) groups of nozzles being nozzle groups excluding k groups of nozzles (k being an odd integer satisfying 1≤k<K) from the K groups of nozzles.

11 Claims, 10 Drawing Sheets

(First Embodiment: Color Bidirectional Print)

(Comparative Example: Color Bidirectional Print)

(Second Embodiment: Color Single Directional Print)

(Third Embodiment:
Color Bidirectional Print)

(Third Embodiment:
Color Single Directional Print)

CONTROL DEVICE

CROSS-REFERENCE TO RELATED APPLICATIONS

This application claims priority to Japanese Patent Application No. 2014-116216, filed on Jun. 4, 2014, the contents of which are hereby incorporated by reference into the present application.

TECHNICAL FIELD

The present specification discloses a control device for controlling a print performing unit.

DESCRIPTION OF RELATED ART

A printing device is known that is configured to perform printing of an image on a print medium by moving a print head along a main scanning direction and transferring the print medium along a sub scanning direction. The print head is provided with a plurality of nozzle lines. Each of the plurality of nozzle lines includes four types of nozzles for discharging four colors of ink, i.e., black ink (K), cyan ink (C), magenta ink (M), and yellow ink (Y).

SUMMARY

The present specification discloses a novel technique that causes a print performing unit to perform color printing of an image on a print medium.

A control device may be a device for controlling a print performing unit. The print performing unit may comprise a print head configured to perform a main scanning operation of discharging ink while moving along a first direction. The print head may comprise K groups of nozzles (K may be an integer equal to or more than 2) provided along a second direction being orthogonal to the first direction. In the K groups of nozzles, a first type of nozzle group and a second type of nozzle group may be alternately provided along the second direction. The first type of nozzle group may comprise a first type of nozzle line including N pieces of nozzles (N may be an integer equal to or more than 2) provided along the first direction. The second type of nozzle group may comprise a second type of nozzle line including N pieces of nozzles provided along the first direction. A color of ink discharged by an n-th nozzle (n may be each integer satisfying $1 \leq n \leq N$) from a first side of the first direction among the N pieces of nozzles included in the first type of nozzle line may be identical to a color of ink discharged by an n-th nozzle from a second side of the first direction among the N pieces of nozzles included in the second type of nozzle line. The control device may comprise a processor and a memory storing computer-readable instructions therein. The computer-readable instructions, when executed by the processor, may cause the control device to perform acquiring image data representing a target image of a print target. The computer-readable instructions, when executed by the processor, may cause the control device to perform creating print data by using the image data. The computer-readable instructions, when executed by the processor, may cause the control device to perform supplying the print data to the print performing unit. The creating of the print data may include selecting one printing method for printing the target image on a print medium from among a plurality of printing methods including a first printing method and a second printing method. The first printing method may be a printing method for performing a color printing of the target image by the print head conducting both of a first main scanning operation and a second main scanning operation, the first main scanning operation may include discharging ink while moving from the first side to the second side in the first direction, the second main scanning operation may include discharging ink while moving from the second side to the first side in the first direction. The second printing method may be a printing method for performing a color printing of the target image by the print head conducting only a specific main scanning operation, the specific scanning main operation which may be one of the first main scanning operation and the second main scanning operation. The creating of the print data may include creating, in a case where one of the first printing method and the second printing method is selected, first print data for causing all of the K groups of nozzles to discharge ink so as to perform the color printing of the target image, and creating, in a case where the other of the first printing method and the second printing method is selected, second print data for causing (K−k) groups of nozzles to discharge ink so as to perform the color printing of the target image, the (K−k) groups of nozzles may be nozzle groups excluding k groups of nozzles (k being an odd integer satisfying $1 \leq k < K$) from the K groups of nozzles, the k groups of nozzles being positioned at an end of the second direction.

A control method and computer-readable instructions for realizing the aforementioned control device are also novel and useful. Furthermore, a computer-readable recording medium that stores the aforementioned computer-readable instructions is also novel and useful. Furthermore, a print system that comprises the aforementioned control device and the aforementioned print performing unit is also novel and useful.

EMBODIMENT

Embodiment 1

Configuration of Print System 2

FIG. 1

Figure 1:
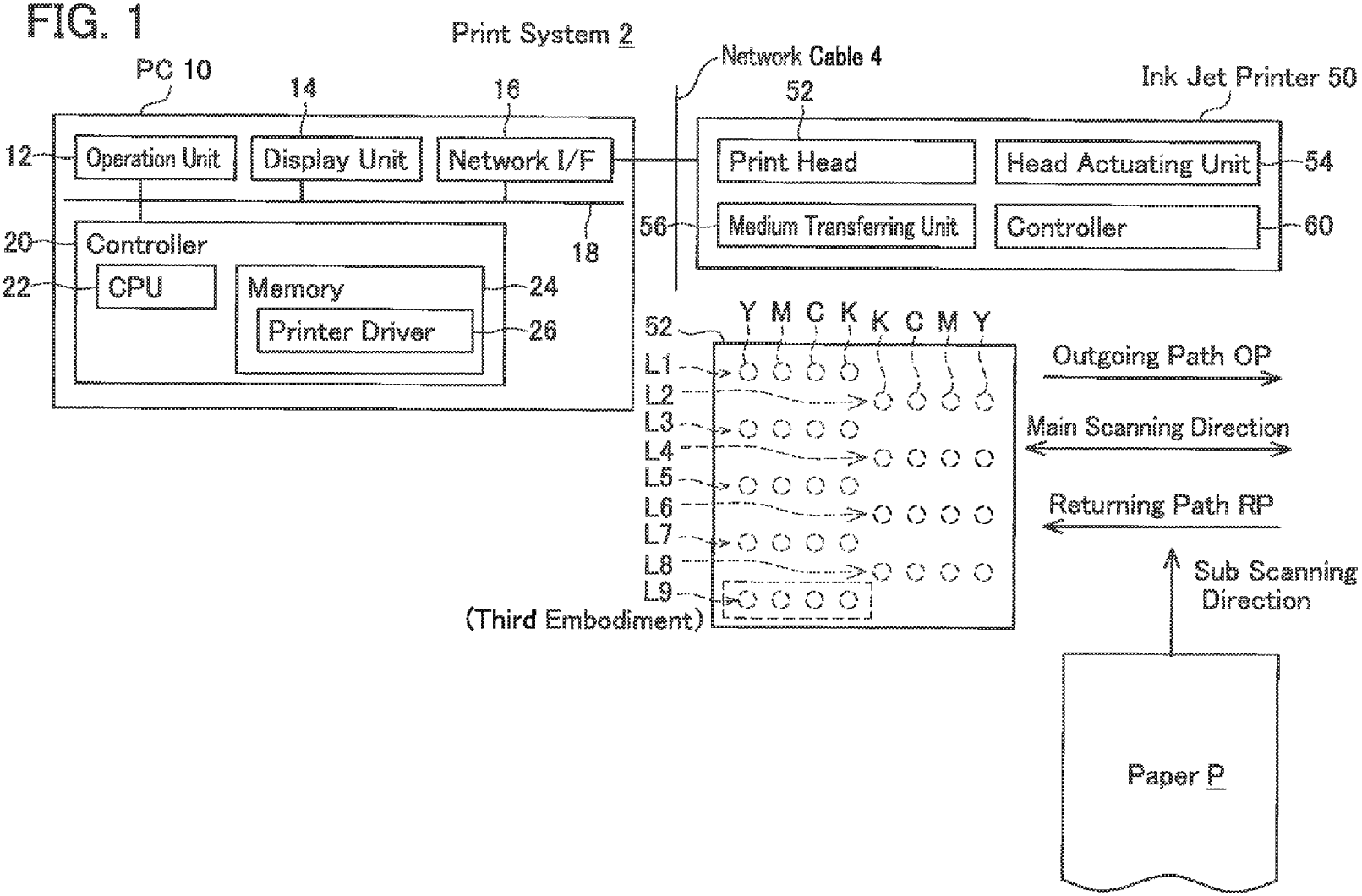
FIG. 1 shows the configuration of a print system.

As shown in FIG. 1, a print system 2 comprises a PC 10, and an ink jet printer 50, which is a peripheral apparatus of the PC 10. The PC 10 and the ink jet printer 50 are able to communicate with one another via a network cable 4 (i.e., a network). Hereinbelow, the ink jet printer 50 may simply be called "printer 50".

(Configuration of PC 10)

The PC 10 comprises an operation unit 12, a display unit 14, a network interface 16, and a controller 20. Each unit 12, 14, 16 and 20 is connected to a bus line 18. The operation unit 12 is configured using a keyboard and a mouse. A user can input various instructions to the PC 10 by operating the operation unit 12. The display unit 14 is a display for displaying various information. The network cable 4 is connected to the network interface 16.

The controller 20 comprises a CPU 22 and a memory 24, such as ROM, RAM, and a hard disk. The CPU 22 is configured to perform various processing in accordance with a program (e.g.: a printer driver 26) stored in the memory 24. The memory 24 stores a printer driver 26 for the printer 50. The printer driver 26 is installed in the PC 10 from media that are packaged together with the printer 50. Furthermore, in a modification, the printer driver 26 may be installed in the PC 10 via the Internet from a server provided by the printer 50 vendor.

(Configuration of Ink Jet Printer 50)

The printer 50 is a so-called serial-type ink jet printer. The printer 50 comprises a print head 52, a head actuating unit 54, a medium transferring unit 56, and a controller 60. FIG. 1 shows a simplified plan view of the print head 52. The print head 52 comprises eight nozzle lines L1 to L8. The eight nozzle lines L1 to L8 are lined up along a sub scanning direction (that is, the upward direction in FIG. 1), which is the transferring direction of the paper P. In FIG. 1, a nozzle line L9 is also shown, but the print head 52 of the present embodiment does not comprise the nozzle line L9. Nozzle line L9 is used in the third embodiment described below.

Each nozzle line comprises four nozzles for discharging four types of colored ink, including three types of chromatic colors, i.e., cyan (C), magenta (M), and yellow (Y), and one type of achromatic color, i.e., black (K). Hereinbelow, the nozzles that discharge the respective colors of ink C, M, Y, and K may be called "C nozzle", "M nozzle", "Y nozzle", and "K nozzle", respectively. The four nozzles in each nozzle line are lined up in a straight line along the main scanning direction (that is, the left-right direction in FIG. 1), which is the moving direction of the print head 52. The four nozzles in each of nozzle lines L1, L3, L5 and L7 are lined up in the order Y nozzle, M nozzle, C nozzle and K nozzle in the direction of an outgoing path of the main scanning direction. In contrast to this, the four nozzles in each of nozzle lines L2, L4, L6 and L8 are lined up in the order Y nozzle, M nozzle, C nozzle, and K nozzle in the direction of a returning path of the main scanning direction (that is, in the order K nozzle, C nozzle, M nozzle and Y nozzle in the direction of the outgoing path). Hereinbelow, the outgoing path and the returning path in the main scanning direction of the print head 52 will respectively be expressed using the reference signs OP (Outgoing Path) and RP (Returning Path). Hereinbelow, nozzle lines to which odd numbers have been assigned such as nozzle lines L1, L3, L5, and L7, may be called "odd-numbered nozzle lines", and nozzle lines to which even numbers have been assigned such as nozzle lines L2, L4, L6, and L8, may be called "even-numbered nozzle lines". That is, in the print head 52, the odd-numbered nozzle lines and the even-numbered nozzle lines are alternately arranged along the sub scanning direction.

The head actuating unit 54, in accordance with an instruction from the controller 60, causes the print head 52 to conduct an reciprocal movement along the main scanning direction. The head actuating unit 54, in accordance with an instruction from the controller 60, also causes ink droplets to be discharged from the print head 52. The medium transferring unit 56, in accordance with an instruction from the controller 60, extracts from a paper feed tray a piece of paper P that is stored in the paper feed tray, and transfers the paper P along the sub scanning direction, which is a direction orthogonal to the main scanning direction. The controller 60, in accordance with print data supplied from the PC 10, controls the operations of the head actuating unit 54 and the medium transferring unit 56.

In the present specification, the discharging of ink from the print head 52 while the print head 52 is moving is called a "main scan (or pass)" hereinbelow. Furthermore, the discharging of ink from the print head 52 while the print head 52 is moving in the outgoing path direction of the main scanning direction is called an "outgoing path main scan", and the discharging of ink from the print head 52 while the print head 52 is moving in the returning path direction of the main scanning direction is called a "returning path main scan" hereinbelow.

Printer Driver Process

FIG. 2

Next, a printer driver process executed by the CPU 22 of the PC 10 will be explained. The user can include in the operation unit 12 an operation for selecting a desired data and printing an image (hereinafter, may be called "target image") represented by the selected data. The aforementioned operation includes an operation for the user to specify a printing condition when the target image is printed. The operation for specifying a printing condition includes an operation for selecting either color printing or monochrome printing, and an operation for selecting either high-quality printing or normal quality printing. High-quality printing signifies printing that has a higher print resolution than normal quality printing. In this example, the contents of processing in which the user has selected RGB bitmap format image data (hereinafter called "RGB image data") will be explained. When data of another format (e.g., text data, bitmap format image data other than RGB, text-bitmap composite data, and so forth) has been selected, the CPU 22 converts the user-selected data to RGB image data using a known technique. When the aforementioned operation is performed, the CPU 22 executes a printer driver process shown in FIG. 2 in accordance with the printer driver 26.

Figure 3:
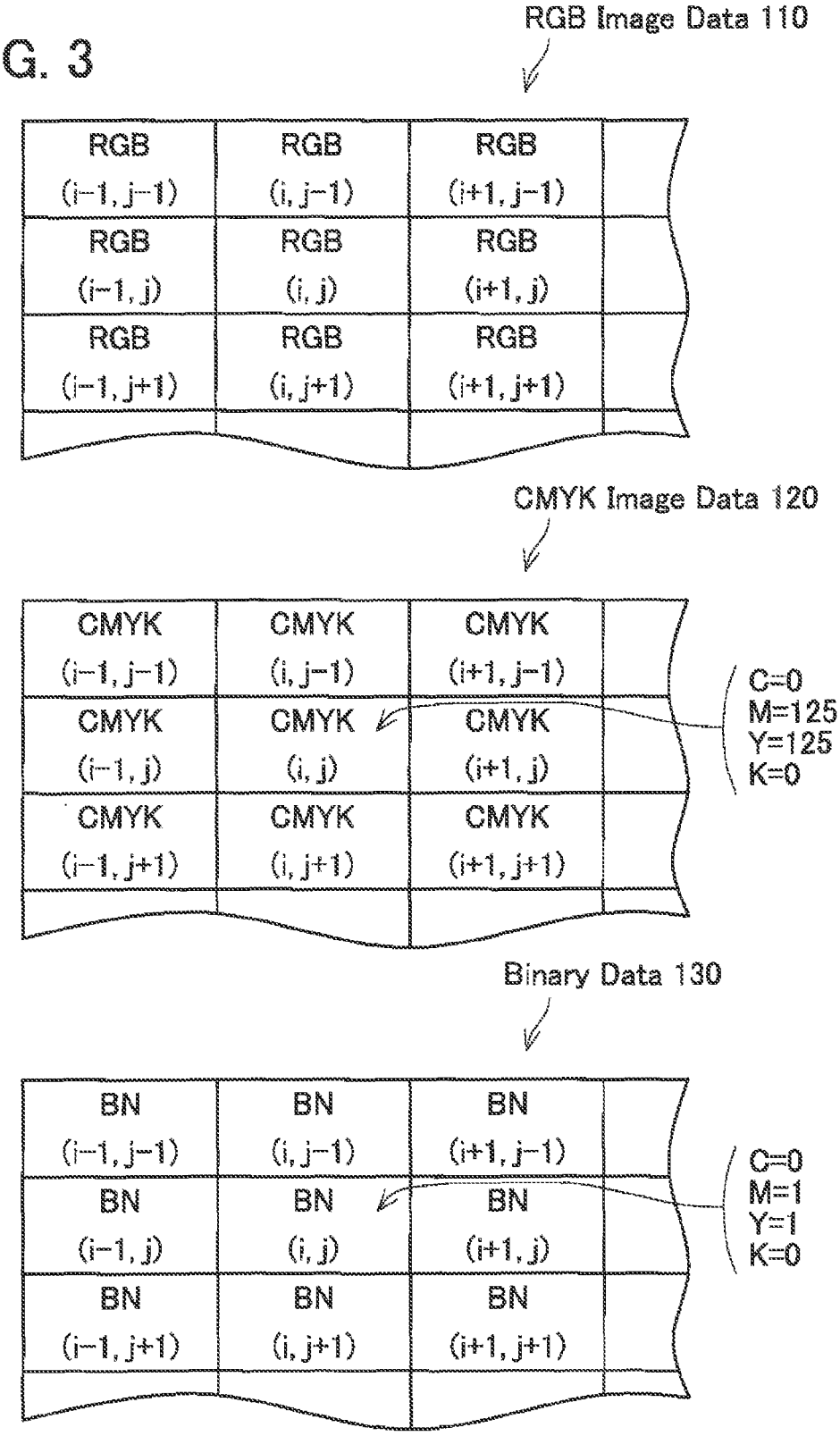
FIG. 3 shows examples of RGB image data, CMYK image data, and binary data.

In S10, the CPU 22 receives a print instruction. The print instruction includes the user-selected RGB image data and printing condition information indicating the printing condition specified by the user. As shown in FIG. 3, the RGB image data 110 includes a plurality of pixels. Coordinates like RGB (i, j) are allocated to each pixel. Each pixel is configured using an R value, a G value and a B value. The R value, G value, and B value are each multi-value data of 256 gradation levels (0 to 255). In the present embodiment, the target image is printed on the paper P such that the vertical direction of FIG. 3 of the target image represented by the RGB image data 110 is rendered along the sub scanning direction, and the horizontal direction of FIG. 3 of the target image is rendered along the main scanning direction.

In S12, the CPU 22 determines whether monochrome printing has been designated by the user or not. Specifically, in S12, the CPU 22 determines whether the printing condition information included in the print instruction received in S10 indicates that the user selected monochrome printing or not. When the user has selected monochrome printing, the CPU 22 determines YES in S12, and in S16 sets the print mode to a monochrome bidirectional print mode. The monochrome bidirectional print mode is a mode that creates print data for performing monochrome printing using bidirectional main scanning. As used herein, the bidirectional main scanning signifies performing both an outgoing path main scan and a returning path main scan. Furthermore, bidirectional printing signifies performing printing using bidirectional main scanning. When S16 ends, the processing proceeds to S22.

On the other hand, when color printing has been selected by the user, the CPU 22 determines NO in S12, and in S14, determines whether high-quality printing has been designated by the user or not. Specifically, in S14, the CPU 22 determines whether the printing condition information included in the print instruction received in S10 indicates that the user selected high-quality printing or not. When high-quality printing has been selected by the user, the CPU 22 determines YES in S14, and in S18, sets the print mode to a color single directional print mode. The color single directional print mode is a mode that creates print data for performing color printing using single directional main scanning. As used herein, the single directional main scanning signifies performing only the outgoing path main scan or the returning path main scan. Furthermore, single directional printing signifies performing printing using the single directional main scanning. When S18 ends, the processing proceeds to S22. On the other hand, when normal quality printing has been selected by the user, the CPU 22 determines NO in S14, and in S20, sets the print mode to a color bidirectional print mode. The color bidirectional print mode is a mode that creates print data for performing color printing using bidirectional main scanning. When S20 ends, the processing proceeds to S22.

Color single directional printing can realize higher quality printing than color bidirectional printing. The reason for this is as follows. A case where color bidirectional printing is performed is assumed to be a case in which after a dot has been formed in a prescribed location along the main scanning direction using a first main scan, an attempt is made to form a dot in the same prescribed location using a second main scan. In the color bidirectional printing, for example, the first main scan is the outgoing path main scan, and the second main scan is the returning path main scan. In this case, since the direction of the main scanning differs between the first main scan and the second main scan, there is the likelihood of a situation occurring in which the location where the dot is formed varies between the first main scan and the second main scan. By contrast, a case where the color single directional printing is performed is assumed to be a case in which after a dot has been formed in a prescribed location along the main scanning direction using a first main scan, an attempt is made to form a dot in the same prescribed location using a second main scan. In this case, since the first main scan and the second main scan are both outgoing path main scans (or returning path main scans), a situation in which the location where the dot is formed varies between the first main scan and the second main scan is less likely to occur. For this reason, color single directional printing can realize higher quality printing than color bidirectional printing. Therefore, in the present embodiment, when high-quality printing is selected by the user, the CPU 22 sets the print mode to the color single directional print mode rather than the color bidirectional print mode.

In S22, the CPU 22 executes a color conversion process. In S22, the CPU 22 converts the RGB image data 110 (FIG. 3) to CMYK image data 120. CMYK image data is image data in a CMYK bitmap format. The CMYK image data 120 also includes a plurality of pixels. One pixel defined by the CMYK format (e.g., CMYK (i, j) in FIG. 3) is obtained from one pixel in the RGB image data 110 (e.g., RGB (i, j) in FIG. 3). Each pixel in the CMYK image data 120 is configured using a C value, an M value, a Y value, and a K value. The C value, M value, Y value, and K value are each multi-value data of 256 gradation levels (0 to 255). Furthermore, when the set print data create mode is the monochrome bidirectional print mode (refer to S16), all of the C values, M value, and Y values of each pixel in the CMYK image data 120 created in S22 are zero.

Next, in S24, the CPU 22 executes a half tone process. An error diffusion method, a dither method, or the like can be given as examples of a half tone process. In S24, the CPU 22 converts the CMYK image data 120 (FIG. 3) to binary data 130. Binary data 130 is image data in a binary bitmap format of "dot ON (=1)" and "dot OFF (=0)". The binary data 130 also includes a plurality of pixels. One pixel defined using binary is obtained from one pixel in the CMYK image data 120. Each pixel in the binary data 130 is configured using a C value, an M value, a Y value, and a K value. The C value, M value, Y value, and K value are each represented binary as "dot ON (=1)" and "dot OFF (=0)". Furthermore, when the set print data create mode is the monochrome bidirectional print mode, all of the C values, M values, and Y values of each pixel in the binary data 130 created in S24 are zero (i.e., dot OFF). In the present embodiment, dot ON and dot OFF binary data is created, but in the other examples, ternary or more than ternary data may be created. For example, quaternary data, such as large dot ON (=3), medium dot ON (=2), small dot ON (=1), and dot OFF (=0), may be created.

Next, in S26, the CPU 22 determines whether the set data mode is the monochrome bidirectional print mode or not. When the set data mode is the monochrome bidirectional print mode, the CPU 22 determines YES in S26, and proceeds to S34. On the other hand, when the set data mode is either the color bidirectional print mode or the color single directional print mode, the CPU 22 determines NO in S26, and proceeds to S28. In S28, the CPU 22 determines whether the set print mode is the color bidirectional print mode or not. When the set print mode is the color bidirectional print mode, the CPU 22 determines YES in S28, and proceeds to S30. On the other hand, when the set print mode is the color single directional print mode, the CPU 22 determines NO in S28, and proceeds to S32.

Figure 4:
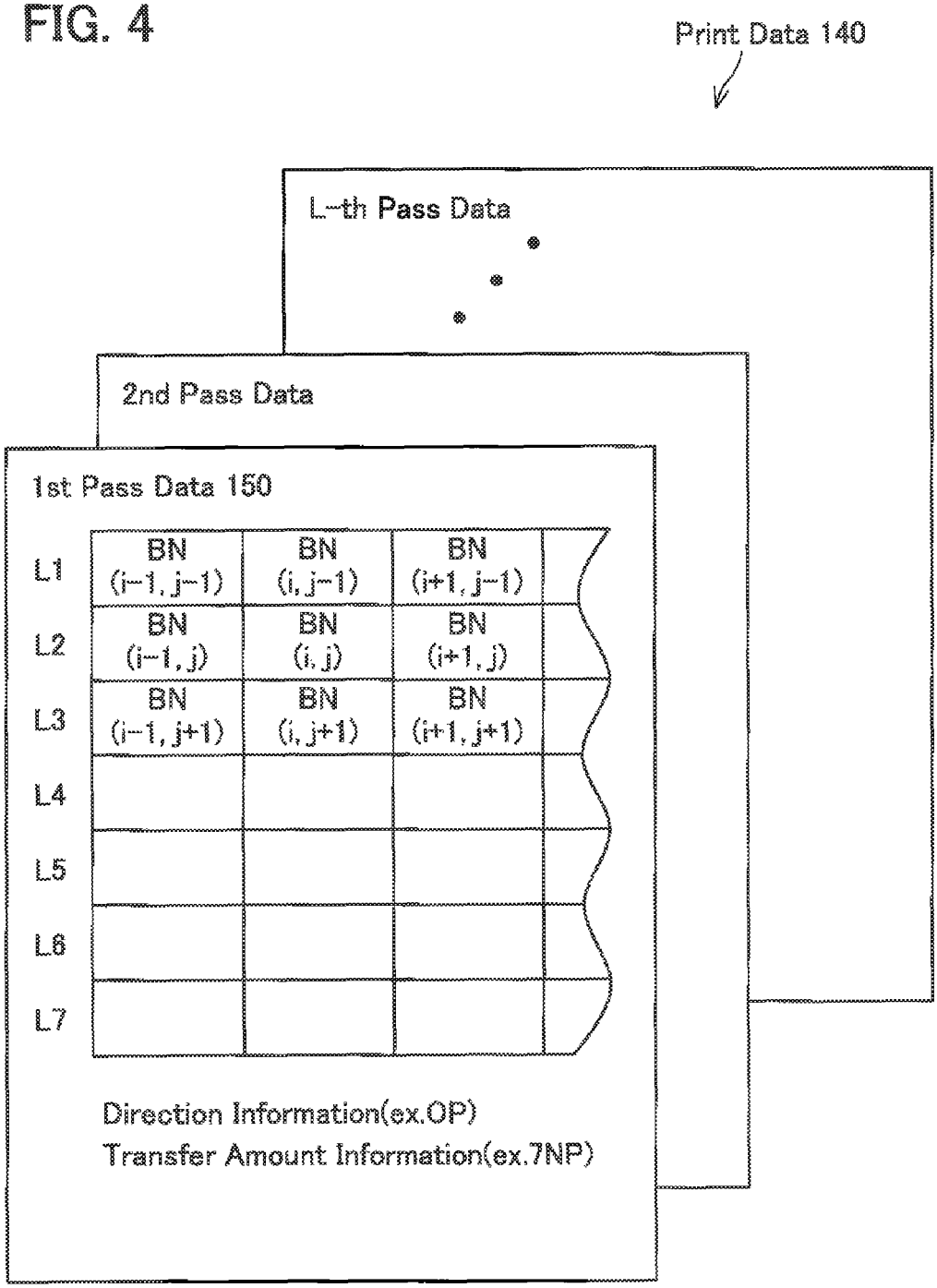
FIG. 4 shows an example of print data.

In S30, the CPU 22 uses the binary data created in S24 to create print data for performing color bidirectional printing using the seven nozzle lines L1 to L7 from among the eight nozzle lines L1 to L8 of the print head 52. That is, in S30, the CPU 22 creates print data for performing printing without using nozzle line L8 (i.e., the nozzle line at the upstream end in the sub scanning direction). FIG. 4 shows an example of the print data 140 created in S30. As shown in FIG. 4, the print data 140 includes a plurality (L in FIG. 4, where L is an integer of 2 or more) pass data. The aforementioned "pass" corresponds to one pass (i.e., one main scan). Each piece of pass data (e.g., pass data 150 of a first pass) includes a plurality of pixels corresponding to the pertinent nozzle line for each of the seven nozzle lines L1 to L7. In the pass data 150 of FIG. 4, the respective pixels BN (i−1, j−1), BN (i, j−1), BN (I+1, j−1), . . . are associated with the nozzle line L1. The pixels in the pass data correspond to the pixels included in the binary data. The C value, M value, Y value, and K value of each pixel in the pass data are each represented binary as either "dot ON (=1)" or "dot OFF (=0)". Each piece of pass data also includes direction information (e.g., OP) indicating which direction the print head 52 is being made to move in, i.e., the outgoing path OP direction or the returning path RP direction, and transfer amount information (e.g., 7NP (where NP is the abbreviation for Nozzle Pitch)) indicating the amount of paper P transferred in the sub scanning direction. The contents of the color bidirectional printing realized using the print data 140 created in S30 will be explained in detail later (refer to FIG. 5). When S30 ends, the processing proceeds to S36.

In S32, the CPU 22 uses the binary data created in S24 to create print data for performing color single directional printing using all eight nozzle lines L1 to L8 of the print head 52. The print data created in S32 also has a plurality of pass data in the same manner as the print data created in S30 (refer to FIG. 4). Furthermore, each piece of pass data includes a plurality of pixels corresponding to the pertinent nozzle line for each of the eight nozzle lines L1 to L8. Each piece of pass data also includes direction information (i.e., OP or RP) and transfer amount information (i.e., 8NP). The contents of the color single directional printing realized using the print data created in S32 will be explained in detail later (refer to FIG. 6). When S32 ends, the processing proceeds to S36.

In S34, the CPU 22 uses the binary data created in S24 to create print data for performing monochrome bidirectional printing using all eight nozzle lines L1 to L8 of the print head 52. The print data created in S34 also has a plurality of pass data in the same manner as the print data created in S30 (refer to FIG. 4). Furthermore, each piece of pass data includes a plurality of pixels corresponding to the pertinent nozzle line for each of the eight nozzle lines L1 to L8. The respective pixels in the pass data correspond to the respective pixels included in the binary data. However, in the case of monochrome printing, all of the C values, M values, and Y values of the respective pixels on the binary data created in S24 are zero. Each piece of pass data also includes direction information (i.e., OP or RP) and transfer amount information (i.e., 8NP). The contents of the monochrome bidirectional printing realized using the print data created in S34 will be explained in detail later. When S34 ends, the processing proceeds to S36.

In S36, the CPU 22 supplies the created print data to the printer 50. This makes it possible for the printer 50 to perform printing in accordance with the supplied print data. When S36 ends, the printer driver process of FIG. 2 ends.

Color Bidirectional Printing of Embodiment 1

FIG. 5

Figure 5:
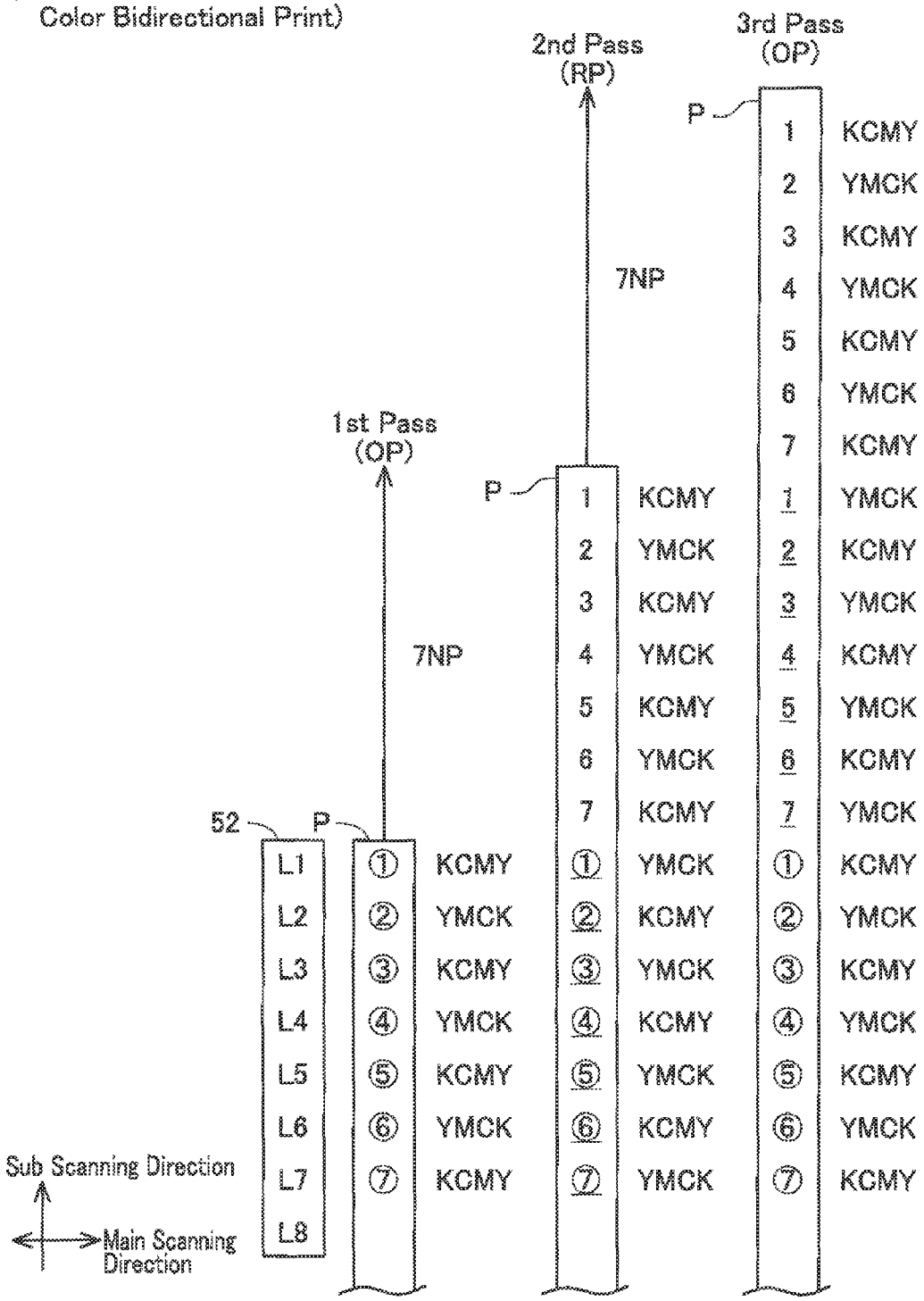
FIG. 5 shows an example of a case where color bidirectional printing is performed in a first embodiment.

The contents of the color bidirectional printing of the first embodiment will be explained. Upon acquiring the print data created in S30 of FIG. 2 (i.e., print data 140 of FIG. 4) from the PC 10, the printer 50 performs the color bidirectional printing shown in FIG. 5 in accordance with this print data. FIG. 5 shows the first through the third passes of the printing. L1 to L8 inside the print head 52 of FIG. 5 indicate the nozzle lines L1 to L8. In FIG. 5, the paper P is represented by a thin rectangular shape.

(First Pass)

Figure 2:
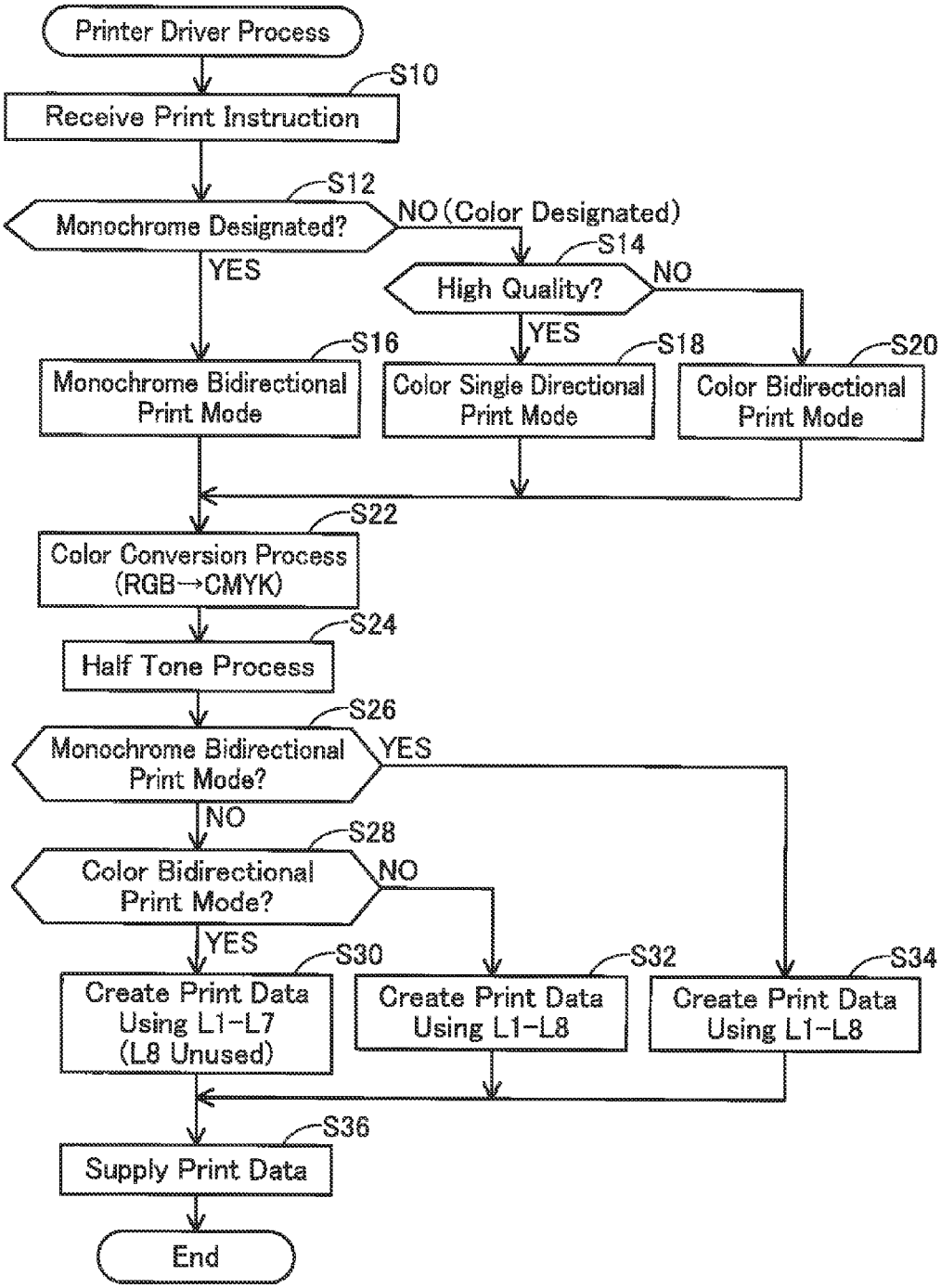
FIG. 2 shows a flowchart of a printer driver process.

The printer 50 performs a print head 52 main scan in accordance with pass data 150 of a first pass included in the print data 140. Specifically, the controller 60 causes the print head 52 to conduct an outgoing path OP main scan. Specifically, the printer 50, while moving the print head 52 in the direction of the outgoing path OP, causes ink droplets to be discharged from the respective nozzles in accordance with each pixel included in the pass data of the first pass. For example, when all of the C value, M value, Y value and K value included in a single pixel are "1 (=dot ON)", the controller 60 causes ink droplets to be discharged from each of the C nozzle, the M nozzle, the Y nozzle, and the K nozzle such that a single dot is formed in the location on the paper P corresponding to the pertinent pixel. As described hereinabove, the print data created in S30 of FIG. 2 is for performing printing without using nozzle line L8 (i.e., the nozzle line at the upstream end in the sub scanning direction). Therefore, the printer 50 performs printing by causing ink droplets to be discharged only from the respective nozzles included in the seven nozzle lines L1 to L7 excluding nozzle line L8 from the nozzle lines L1 to L8 of the print head 52.

The numerals "1" to "7" on the portion of the paper P corresponding to the first pass of FIG. 5 each indicates a group of dots formed by the respective nozzles included in the nozzle lines L1 to L7. Hereinbelow, a group of dots formed on the paper P and lined up linearly along the main scanning direction in accordance with one main scan (i.e., one pass) being performed and ink droplets being discharged from a single nozzle line may be called a "raster". In the drawings corresponding to the second and subsequent passes, a numeral on the paper indicates a raster formed by the respective nozzles included in the nozzle line that corresponds to the numeral. Furthermore, in the drawings corresponding to the respective passes, a numeral enclosed in a circle indicates a raster formed in the pertinent pass, and a numeral not enclosed in a circle indicates a raster formed in a pass prior to this pass. Also, an underlined numeral is a raster formed when returning path main scanning is performed, and a numeral that is not underlined is a raster formed when outgoing path main scanning is performed. Hereinbelow, the same holds true for the respective drawings in FIGS. 6 to 10.

In the main scan of the first pass, the controller 60 causes the print head 52 to conduct an outgoing path OP main scan. In the main scan of the first pass, the nozzles of the odd-numbered nozzle lines L1, L3, L5 and L7 pass over the paper P in the order of the K nozzle, the C nozzle, the M nozzle, and the Y nozzle. That is, the order in which each color of ink is deposited onto the paper P at each dot is also K, C, M, Y. FIG. 5 shows this deposition order as "KCMY". Also, in the main scan of the first pass, each of the nozzles of the even-numbered nozzle lines L2, L4, and L6 pass over the paper P in the order of the Y nozzle, the M nozzle, the C nozzle, and the K nozzle. That is, the order in which each color of ink is deposited onto the paper P at each dot is also Y M, C, K. FIG. 5 shows this deposition order as "YMCK".

Generally speaking, when a color image is printed, the printer 50 may ordinarily form a single dot on the paper using droplets of ink of two or more types of colors of the four types of colors CMYK. For example, when a green colored portion is printed, the printer 50 forms one green dot on the paper by causing a cyan ink droplet and a yellow ink droplet to be deposited at the same location on the paper. In a nozzle line for which the deposition order of the respective inks at scan time (hereinafter, simply called "deposition order") is "KCMY", after a cyan ink droplet discharged from the C nozzle has been deposited at a prescribed location on the paper, a yellow ink droplet discharged from the Y nozzle is deposited at this prescribed location. That is, a single green dot is formed by depositing a yellow ink droplet on top of a cyan ink droplet. On the other hand, in a nozzle line for which the deposition order is "YMCK", after a yellow ink droplet discharged from the Y nozzle has been deposited at a prescribed location on the paper, a cyan ink droplet discharged from the C nozzle is deposited at this prescribed location. That is, a single green dot is formed by depositing a cyan ink droplet on top of a yellow ink droplet.

Therefore, because the order for depositing the respective cyan and yellow ink droplets onto the paper for forming a single green dot is different in a case where printing is performed using a nozzle line for which the deposition order is "KCMY" and a case where printing is performed using a nozzle line for which the deposition order is "YMCK", the color of the green dot may look different. In the present embodiment, in the main scan of the first pass, a raster printed using the deposition order "KCMY" and a raster printed using the deposition order "YMCK" are formed alternately. When the main scan of the first pass of the print head 52 ends, the printer 50 transfers the paper P by seven nozzle pitches (7NP) to the downstream side in the sub scanning direction.

(Second Pass)

Next, the printer 50 performs a print head 52 main scan in accordance with pass data of a second pass included in the print data 140. Specifically, the controller 60 causes the print head 52 to conduct returning path RP main scanning Specifically, the printer 50, while moving the print head 52 in the direction of the returning path RP, causes ink droplets to be discharged from respective nozzles in accordance with each pixel included in the pass data of the second pass. In the main scan of the second pass, the printer 50 also performs printing by causing ink droplets to be discharged only from the respective nozzles included in the seven nozzle lines L1 to L7 of the print head 52.

In the main scan of the second pass, each of the nozzles of the odd-numbered nozzle lines L1, L3, L5 and L7 passes over the paper P in the order of the Y nozzle, the M nozzle, the C nozzle, and the K nozzle. That is, the deposition order of the inks of the raster corresponding to the odd-numbered nozzle lines L1, L3, L5 and L7 is "YMCK". Also, each of the nozzles of the even-numbered nozzle lines L2, L4, and L6 passes over the paper P in the order of the K nozzle, the C nozzle, the M nozzle, and the Y nozzle. That is, the deposition order of the inks of the raster corresponding to the even-numbered nozzle lines L2, L4, and L6 is "KCMY". When the print head 52 main scan of the second pass ends, the printer 50 transfers the paper P by 7NP to the downstream side in the sub scanning direction.

(Third Pass)

Next, the printer 50 performs a print head 52 main scan in accordance with pass data of a third pass included in the print data 140. That is, the controller 60 causes the print head 52 to conduct an outgoing path OP main scan. Specifically, the printer 50, while moving the print head 52 in the direction of the outgoing path OP, causes ink droplets to be discharged from respective nozzles in accordance with each pixel included in the pass data of the third pass. In the main scan of the third pass, the printer 50 also performs printing by causing ink droplets to be discharged only from the respective nozzles of the nozzle lines L1 to L7 of the print head 52.

In the main scan of the third pass, the deposition order of the inks of rasters corresponding to the odd-numbered nozzle lines L1, L3, L5, and L7 is "KCMY". Furthermore, the deposition order of the inks of rasters corresponding to the even-numbered nozzle lines L2, L4, and L6 is "YMCK". When the print head 52 main scan of the third pass ends, the printer 50 transfers the paper P by 7NP to the downstream side in the sub scanning direction. Thereafter, the printer 50 repeatedly conducts outgoing path OP main scans and returning path RP main scans in an alternating manner until the print head 52 main scan of the L-th pass ends.

When color bidirectional printing ends, as shown in FIG. 5, printing is performed such that rasters with a deposition order of "KCMY" (i.e., the rasters corresponding to the nozzle lines L1, L3, L5, and L7 of the first pass, the nozzle lines L2, L4, and L6 of the second pass, and the nozzle lines L1, L3, L5, and L7 of the third pass in FIG. 5), and rasters with a deposition order of "YMCK" (i.e., rasters corresponding to the nozzle lines L2, L4, and L6 of the first pass, the nozzle lines L1, L3, L5, and L7 of the second pass, and the nozzle lines L2, L4, and L6 of the third pass in FIG. 5) are formed in an alternating manner.

Color Single Directional Printing of Embodiment 1

FIG. 6

Figure 6:
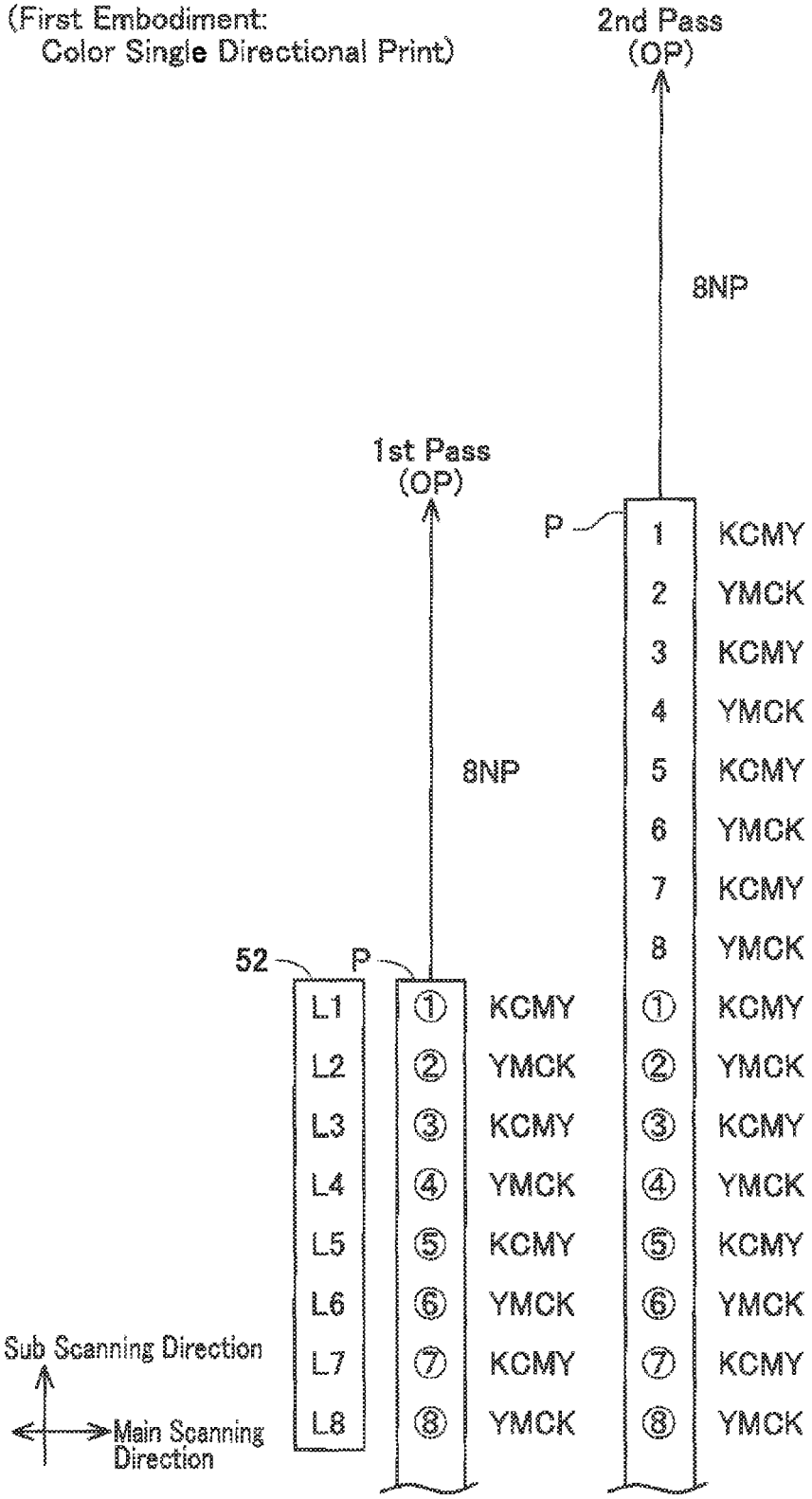
FIG. 6 shows an example of a case where color single directional printing is performed in the first embodiment.
Figure 7:
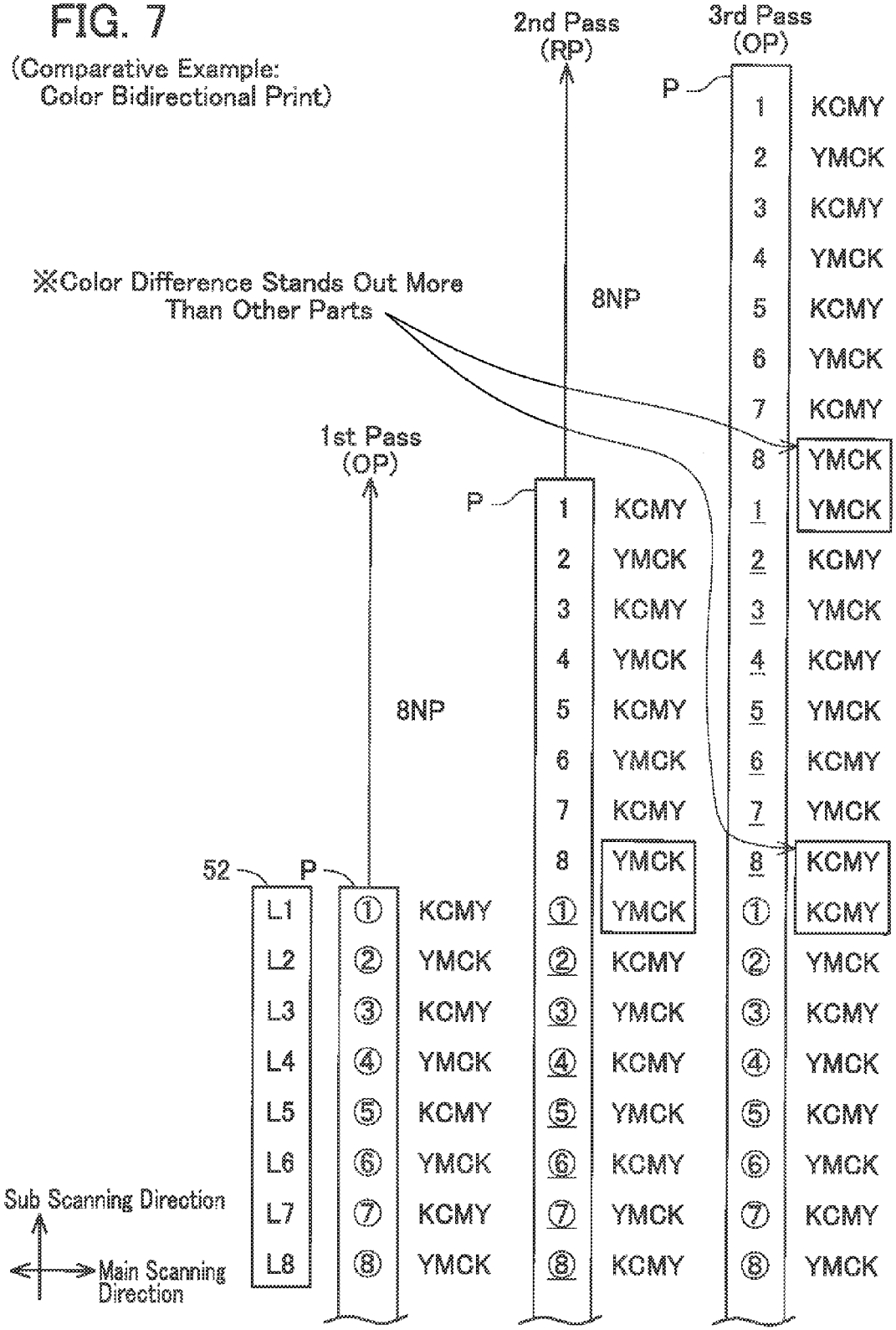
FIG. 7 shows an example of a case where color bidirectional printing is performed in a comparative example.

The contents of the color single directional printing of the first embodiment will be explained. The printer 50, upon acquiring the print data created in S32 of FIG. 2 from the PC 10, performs the color single directional printing shown in FIG. 6 in accordance with this print data. FIG. 6 shows the printing of the first and second passes.

(First Pass)

First of all, the printer 50 conducts a print head 52 main scan in accordance with pass data of the first pass included in the print data. Specifically, the controller 60 causes the print head 52 to conduct an outgoing path OP main scan. Specifically, the printer 50, while moving the print head 52 in the direction of the outgoing path OP, causes ink droplets to be discharged from the respective nozzles in accordance with each pixel included in the pass data of the first pass. As described hereinabove, the print data created in S32 of FIG. 2 is for performing printing using all of the nozzle lines L1 to L8. Therefore, the printer 50 performs printing by causing ink droplets to be discharged from all of the nozzle lines L1 to L8 of the print head 52.

In the main scan of the first pass, the nozzles of the odd-numbered nozzle lines L1, L3, L5, and L7 pass over the paper P in the order of the K nozzle, the C nozzle, the M nozzle, and the Y nozzle. That is, the deposition order of the inks of the rasters corresponding to the odd-numbered nozzle lines L1, L3, L5, and L7 is "KCMY". Also, the nozzles of the even-numbered nozzle lines L2, L4, and L6 pass over the paper P in the order of the Y nozzle, the M nozzle, the C nozzle, and the K nozzle. That is, the deposition order of the inks of the rasters corresponding to the even-numbered nozzle lines L2, L4, L6, and L8 is "YMCK". When the print head 52 main scan of the first pass ends, the printer 50 transfers the paper P by 8NP to the downstream side in the sub scanning direction.

(Second Pass)

Next, the printer 50 conducts a print head 52 main scan in accordance with pass data of a second pass included in the print data. In the second pass, an outgoing path OP main scan is performed. In the main scan of the second pass, the deposition order of the inks of the rasters corresponding to the odd-numbered nozzle lines L1, L3, L5, and L7 is "KCMY". Also, the deposition order of the inks of the rasters corresponding to the even-numbered nozzle lines L2, L4, L6, and L8 is "YMCK". When the print head 52 main scan of the second pass ends, the printer 50 transfers the paper P by 8NP to the downstream side in the sub scanning direction. Thereafter, the printer 50 repeatedly performs outgoing path OP main scans until the print head 52 main scan of the L-th pass ends.

When the color single directional printing ends, printing is performed such that the rasters with the deposition order of "KCMY" (i.e., the rasters corresponding to the odd-numbered nozzle lines L1, L3, L5, and L7), and the rasters with the deposition order of "YMCK" (i.e., the rasters corresponding to the even-numbered nozzle lines L2, L4, L6 and L8) are formed in an alternating manner.

Monochrome Bidirectional Printing of Embodiment 1

The contents of the monochrome bidirectional printing of the present embodiment will be explained. The printer 50, upon acquiring the print data created in S34 of FIG. 2 from the PC 10, performs monochrome bidirectional printing in accordance with this print data. The ink deposition order is not an issue with monochrome printing since printing is performed using only black ink. Therefore, a drawing specifically showing the contents of monochrome bidirectional printing has been omitted.

(First Pass)

The controller 60 causes the print head 52 to conduct an outgoing path OP main scan. Specifically, the printer 50, while moving the print head 52 in the direction of the outgoing path OP, causes ink droplets to be discharged from the K nozzle in accordance with each pixel included in the pass data of the first pass. As described hereinabove, the print data created in S34 of FIG. 2 is for performing printing using all of the nozzle lines L1 to L8. Therefore, in the present embodiment, the printer 50 performs printing by causing ink droplets to be discharged from all of the K nozzles included in the nozzle lines L1 to L8 of the print head 52. When the print head 52 main scan of the first pass ends, the printer 50 transfers the paper P by 8NP to the downstream side in the sub scanning direction.

(Second Pass)

The controller 60 causes the print head 52 to conduct a returning path RP main scan. In the second pass, the printer 50 performs printing by causing ink droplets to be discharged from all of the K nozzles included in the nozzle lines L1 to L8 of the print head 52. When the print head 52 main scan of the second pass ends, the printer 50 transfers the paper P by 8NP to the downstream side in the sub scanning direction. Thereafter, the printer 50 repeatedly performs the main scanning of the print head 52 in the outgoing path OP direction and the main scanning of the print head 52 in the returning path RP direction until the print head 52 main scan of the L-th pass ends.

Color Bidirectional Printing of Comparative Example

FIG. 7

Next, the contents of color bidirectional printing of a comparative example will be explained so as to explain the advantages of the present invention. In the comparative example, the printer 50 performs printing by causing ink droplets to be discharged from all of the nozzles included in the nozzle lines L1 to L8 of the print head 52.

(First Pass)

In the main scan of the first pass (i.e., the outgoing path OP main scan), the deposition order of the inks of the rasters corresponding to the odd-numbered nozzle lines L1, L3, L5 and L7 is "KCMY". Also, the deposition order of the inks of the rasters corresponding to the even-numbered nozzle lines L2, L4, L6, and L8 is "YMCK". When the print head 52 main scan of the first pass ends, the printer 50 transfers the paper P by 8NP to the downstream side in the sub scanning direction.

(Second Pass)

In the main scan of the second pass (i.e., the returning path RP main scan), the deposition order of the inks of the rasters corresponding to the odd-numbered nozzle lines L1, L3, L5 and L7 is "YMCK". Also, the deposition order of the inks of the rasters corresponding to the even-numbered nozzle lines L2, L4, L6, and L8 is "KCMY". When the print head 52 main scan of the second pass ends, the printer 50 transfers the paper P by 8NP to the downstream side in the sub scanning direction.

(Third Pass)

In the main scan of the third pass (i.e., the outgoing path OP main scan), the deposition order of the inks of the rasters corresponding to the odd-numbered nozzle lines L1, L3, L5 and L7 is "KCMY". Also, the deposition order of the inks of the rasters corresponding to the even-numbered nozzle lines L2, L4, L6, and L8 is "YMCK". When the print head 52 main scan of the third pass ends, the printer 50 transfers the paper P by 8NP to the downstream side in the sub scanning direction. Thereafter, the printer 50 repeatedly performs outgoing path OP main scans and returning path RP main scans in an alternating manner until the print head 52 main scan of the L-th pass ends.

In the comparative example, when the color bidirectional printing ends, the deposition order of the raster corresponding to each of nozzle line L8 of the first pass and nozzle line L1 of the second pass continues to be "YMCK". In a similar manner, the deposition order of the raster corresponding to each of nozzle line L8 of the second pass and nozzle line L1 of the third pass continues to be "KCMY". There is a high likelihood that the location where two rasters with the same deposition order are contiguous stands out more than the other parts on the paper (i.e., is easier for a person to perceive than the other parts). As a result, a situation arises in which, when the paper is viewed in its entirety, there is a location where it is apparent that the color difference stands out more than the other parts (refer to FIG. 7).

By contrast, in the present embodiment, when the print mode is set to the color bidirectional print mode, as shown in S30 of FIG. 2, the PC 10 creates print data for performing color bidirectional printing using the seven nozzle lines L1 to L7 from the eight nozzle lines L1 to L8 of the print head 52. As shown in FIG. 5, the printer 50 performs color bidirectional printing in accordance with the print data created in S30 of FIG. 2. As a result of this, printing is performed such that rasters with the deposition order of "KCMY" (i.e., the rasters corresponding to the nozzle lines L1, L3, L5, and L7 of the first pass, the nozzle lines L2, L4, and L6 of the second pass, and the nozzle lines L1, L3, L5, and L7 of the third pass in FIG. 5), and rasters with a deposition order of "YMCK" (i.e., rasters corresponding to the nozzle lines L2, L4, and L6 of the first pass, the nozzle lines L1, L3, L5, and L7 of the second pass, and the nozzle lines L2, L4, and L6 of the third pass in FIG. 5) are formed in an alternating manner. When color bidirectional printing is performed, the rasters with the deposition order of "KCMY" and the rasters with the deposition order of "YMCK" are arranged alternately, and no two rasters having the same deposition order are contiguous. Therefore, a situation in which, when the paper is viewed in its entirety, there is a location where it is apparent that the color difference stands out more than the other parts is less likely to occur.

Furthermore, in the present embodiment, when the print mode is set to the color single directional print mode, as shown in S32 of FIG. 2, the PC 10 creates print data for performing color single directional printing using all eight nozzle lines L1 to L8 of the print head 52. As shown in FIG. 6, the printer 50 performs color single directional printing in accordance with the print data created in S32 of FIG. 2. As a result, printing is performed such that rasters with the deposition order of "KCMY" (i.e., the rasters corresponding to the odd-numbered nozzle lines L1, L3, L5, and L7), and rasters with the deposition order of "YMCK" (i.e., rasters corresponding to the even-numbered nozzle lines L2, L4, L6, and L8) are formed in an alternating manner. When color single directional printing is performed, the rasters with the deposition order of "KCMY" and the rasters with the deposition order of "YMCK" are arranged alternately, and no two rasters having the same deposition order are contiguous. Therefore, a situation in which, when the paper is viewed in its entirety, there is a location where it is apparent that the color difference stands out more than the other parts is less likely to occur.

Furthermore, in the present embodiment, when the print mode is set to the monochrome bidirectional print mode, as shown in S34 of FIG. 2, the PC 10 creates print data for performing monochrome bidirectional printing using all eight nozzle lines L1 to L8 of the print head 52. The printer 50 performs monochrome bidirectional printing in accordance with the print data created in S34 of FIG. 2. As described hereinabove, since only black ink is used in monochrome bidirectional printing, the ink deposition order is not an issue. Therefore, in a case where monochrome bidirectional printing is performed, a situation does not arise in which there is a location where it is apparent that the color difference stands out more than the other parts. The printer 50 can perform monochrome bidirectional printing appropriately.

(Correspondence Relationship)

The PC 10 and the printer 50 are examples of "a control device", and "a print performing unit", respectively. The main scanning direction and the sub scanning direction are examples of "a first direction", and "a second direction", respectively. The nozzle lines L1 to L8 are an example of "K groups of nozzles". The odd-numbered nozzle lines L1, L3, L5, and L7 are examples of "a first type of nozzle group", and "a first type of nozzle line". The even-numbered nozzle lines L2, L4, L6, and L8 are examples of "a second type of nozzle group", and "a second type of nozzle line". Color bidirectional printing, color single directional printing, and monochrome bidirectional printing are examples of "a first printing method", "a second printing method", and "a third printing method", respectively. The print data created in S30 of FIG. 2, the print data created in S32 of FIG. 2, and the print data created in S34 of FIG. 2, are examples of "first print data", "second print data", and "third print data", respectively. The nozzle lines L1 to L7 are an example of "(K−k) groups of nozzles being nozzle groups excluding k groups of nozzles (k being an odd integer equal to or more than 1 and less than K) from the K groups of nozzles". The RGB image data is an example of "image data". Information indicating the printing condition included in the print instruction is an example of "quality information". The processing of S10 of FIG. 2 is an example of "acquiring image data". The processing of S30, S32, and S34 of FIG. 2 are examples of "creating print data". The processing of S36 of FIG. 2 is an example of "supplying the print data". The processing of S14 of FIG. 2 is an example of "selecting".

Embodiment 2

Points that differ from the first embodiment will be explained. In the present embodiment, in a case where the print mode is set to the color single directional print mode, the content of the print data created by the CPU 22 in S32 of FIG. 2 and the content of the color single directional printing performed by the printer 50 in accordance with the created print data differ from those of the first embodiment.

In the present embodiment, in S32 of FIG. 2, the CPU 22 creates print data for performing color single directional printing using the nozzle lines L1 to L8. The print data has a plurality of pass data. The print data includes first-time pass data for causing ink to be discharged from the seven nozzle lines L1 to L7 excluding nozzle line L8 (i.e., the nozzle line at the end of the upstream side in the sub scanning direction). The first-time pass data includes direction information indicating that the print head 52 is made to move in the outgoing path OP direction, and transfer amount information indicating that the paper P is made to transfer 6NP. The print data also includes second-time pass data for causing ink to be discharged from the seven nozzle lines L2 to L8 excluding nozzle line L1 (i.e., the nozzle line at the end of the downstream side in the sub scanning direction). The second-time pass data includes direction information indicating that the print head 52 is made to move in the outgoing path OP direction, and transfer amount information indicating that the paper P is made to transfer 8NP. In addition, the print data includes third-time pass data for causing ink to be discharged from the seven nozzle lines L1 to L7 excluding nozzle line L8. The third-time pass data includes direction information indicating that the print head 52 is made to move in the outgoing path OP direction, and transfer amount information indicating that the paper P is made to transfer 6NP.

Thus, the print data created in S32 of FIG. 2 of the present embodiment alternately includes pass data (called first pass data hereinbelow) for causing ink to be discharged from the seven nozzle lines L1 to L7 excluding nozzle line L8, and pass data (called second pass data hereinbelow) for causing ink to be discharged from the seven nozzle lines L2 to L8 excluding nozzle line L1. The first pass data includes transfer amount information indicating that the paper P is made to move 6NP, and the second pass data includes transfer amount information indicating that the paper P is made to move 8NP.

Color Single Directional Printing of Embodiment 2

FIG. 8

Figure 8:
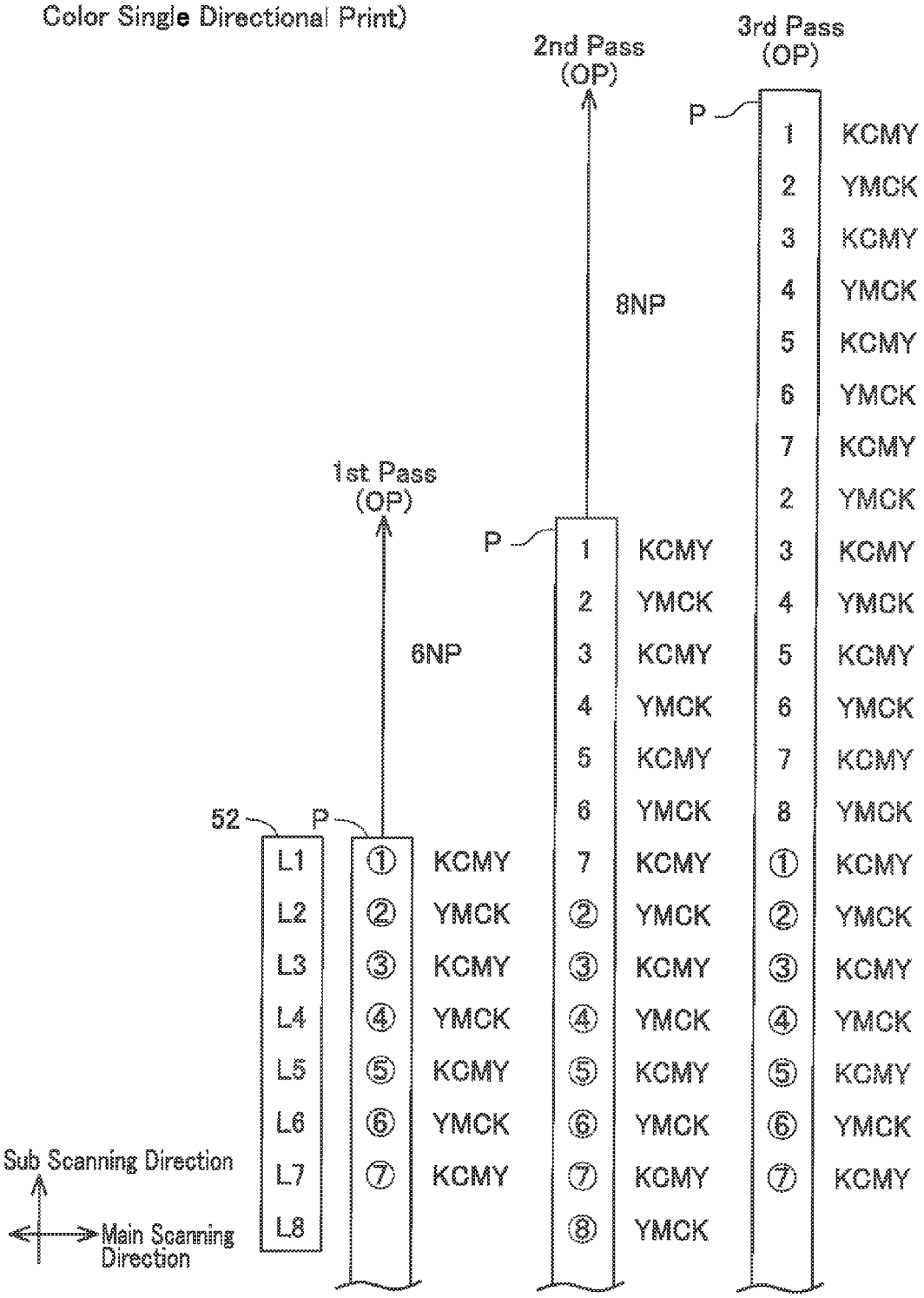
FIG. 8 shows an example of a case where color single directional printing is performed in a second embodiment.

The contents of color single directional printing of the present embodiment will be explained. The printer 50, upon acquiring the print data created in S32 of FIG. 2 from the PC 10, performs the color single directional printing shown in FIG. 8 in accordance with this print data. FIG. 8 shows printing of the first through the third passes.

(First Pass)

As described hereinabove, the first-time pass data is first pass data for performing printing using nozzle lines L1 to L7 excluding nozzle line L8. Therefore, in the first pass, the printer 50 performs printing by causing ink to be discharged from the nozzle lines L1 to L7 of the print head 52. In the main scan of the first pass (i.e., the outgoing path OP main scan), the deposition order of the inks of the rasters corresponding to the odd-numbered nozzle lines L1, L3, L5 and L7 is "KCMY". Also, the deposition order of the inks of the rasters corresponding to the even-numbered nozzle lines L2, L4, and L6 is "YMCK". When the print head 52 main scan of the first pass ends, the printer 50 transfers the paper P by 6NP to the downstream side in the sub scanning direction. Consequently, the location where the nozzle line L7 passes over the paper P at the time of the main scan of the first pass is arranged at the location where the nozzle line L1 passes over the paper P at the time of the main scan of the second pass.

(Second Pass)

The second-time pass data is the second pass data for performing printing using the nozzle lines L2 to L8 excluding nozzle line L1. Therefore, in the second pass, the printer 50 performs printing by causing ink droplets to be discharged from the nozzle lines L2 to L8 of the print head 52. In the main scan of the second pass (i.e., the outgoing path OP main scan), the deposition order of the inks of the rasters corresponding to the even-numbered nozzle lines L2, L4, L6 and L8 is "YMCK". Also, the deposition order of the inks of the rasters corresponding to the odd-numbered nozzle lines L3, L5, and L7 is "KCMY". When the print head 52 main scan of the second pass ends, the printer 50 transfers the paper P by 8NP to the downstream side in the sub scanning direction.

(Third Pass)

The third-time pass data is the first pass data for performing printing using nozzle lines L1 to L7 excluding nozzle line L8 in the same manner as the first-time pass data. Therefore, in the third pass, the printer 50 performs printing by causing ink droplets to be discharged from the nozzle lines L1 to L7 of the print head 52. In the main scan of the third pass, the deposition order of the inks of the rasters corresponding to the odd-numbered nozzle lines L1, L3, L5 and L7 is "KCMY". Also, the deposition order of the inks of the rasters corresponding to the even-numbered nozzle lines L2, L4, and L6 is "YMCK". When the print head 52 main scan of the third pass ends, the printer 50 transfers the paper P by 6NP to the downstream side in the sub scanning direction. Consequently, the location where the nozzle line L7 passes over the paper P at the time of the main scan of the third pass is arranged at the location where the nozzle line L1 passes over the paper P at the time of a main scan of a fourth pass. Thereafter, the printer 50 repeatedly performs the main scanning of the print head 52 using the nozzle lines L1 to L7 and the main scanning of the print head 52 using the nozzle lines L2 to L8 in an alternating manner until the print head 52 main scan of the L-th pass ends.

In the present embodiment, when the print mode is set to the color single directional print mode, the PC 10 creates print data that alternately includes first pass data for causing ink to be discharged from the seven nozzle lines L1 to L7 excluding nozzle line L8, and second pass data for causing ink to be discharged from the seven nozzle lines L2 to L8 excluding nozzle line L1 (refer to S32 of FIG. 2). In addition, the first pass data includes transfer amount information indicating that the paper P is made to move 6NP, and the second pass data includes transfer amount information indicating that the paper P is made to move 8NP. As shown in FIG. 8, the printer 50 performs color single directional printing in accordance with the created print data. As a result, printing is performed such that the rasters with the deposition order of "KCMY" (i.e., the rasters corresponding to the odd-numbered nozzle lines L1, L3, L5, and L7) and the rasters with the deposition order of "YMCK" (i.e., the rasters corresponding to the even-numbered nozzle lines L2, L4, L6, and L8) are formed in an alternating manner. In the present embodiment as well, when color single directional printing is performed, no two rasters of the same deposition order are contiguous. Therefore, a situation in which, when the paper is viewed in its entirety, there is a location where it is apparent that the color difference stands out more than the other parts is less likely to occur.

(Correspondence Relationship)

The main scan of the first pass and the main scan of the third pass are examples of "the specific main scanning operation for an m-th time". The main scan of the second pass is an example of "the specific main scanning operation for an (m+1)-th time". The nozzle lines L1 to L7 are examples of "(K−k) groups of nozzles being nozzle groups excluding k groups of nozzles positioned at an end on a first side of the second direction from the K groups of nozzles". The nozzle lines L2 to L8 are examples of "(K−k) groups of nozzles being nozzle groups excluding the k groups of nozzles positioned at an end on a second side of the second direction from the K groups of nozzles". 6NP and 8NP are examples of "a first transfer amount", and "a second transfer amount", respectively.

Embodiment 3

Points that differ from the first embodiment will be explained. The present embodiment differs from the first embodiment in that the print head 52 has nine nozzle lines L1 to L9. In nozzle line L9, four nozzles, i.e., a C nozzle, an M nozzle, a Y nozzle, and a K nozzle, are arranged in the same manner as the other odd-numbered nozzle lines L1, L3, L5, and L7. When the printer 50 is provided with this kind of print head 52, the contents of the print data created by the CPU 22 in S30 and S32 of FIG. 2, and the contents of the color bidirectional printing and color single directional printing performed by the printer 50 in accordance with the created print data differ from those of the first embodiment.

In the present embodiment, in S30 of FIG. 2, the CPU 22 creates print data for performing color bidirectional printing using all nine of the nozzle lines L1 to L9 of the print head 52. Each piece of pass data included in the print data includes a plurality of pixels corresponding to a relevant nozzle line for each of the nine nozzle lines L1 to L9. Each piece of pass data further includes direction information (i.e., OP or RP) and transfer amount information (i.e., 9NP).

Furthermore, in S32 of FIG. 2, the CPU 22 creates print data for performing color single directional printing using the eight nozzle lines L1 to L8 excluding nozzle line L9 from among the nine nozzle lines L1 to L9 of the print head 52. Each piece of pass data included in the print data includes a plurality of pixels corresponding to a relevant nozzle line for each of the eight nozzle lines L1 to L8. Each piece of pass data further includes direction information (i.e., OP) and transfer amount information (i.e., 8NP).

Color Bidirectional Printing of Embodiment 3

FIG. 9

Figure 9:
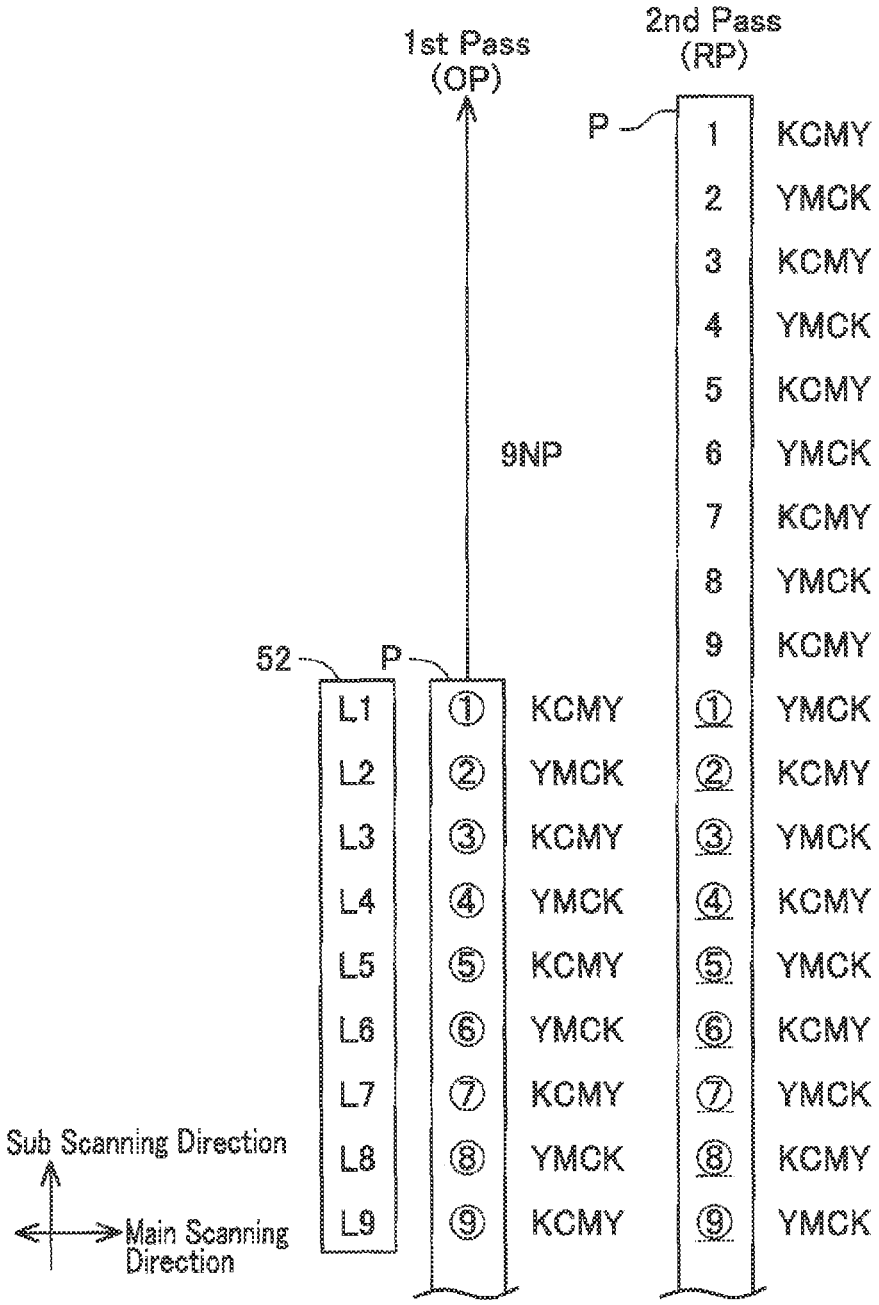
FIG. 9 shows an example of a case where color bidirectional printing is performed in a third embodiment.

The contents of color bidirectional printing of the present embodiment will be explained. The printer 50, upon acquiring print data created in S30 of FIG. 2 from the PC 10, performs the color bidirectional printing shown in FIG. 9 in accordance with this print data. FIG. 9 shows the printing of the first and the second passes. As described hereinabove, the print data created in S32 of FIG. 2 of the present embodiment is for performing printing using all of the nozzle lines L1 to L9. Therefore, in the present embodiment, the printer 50 performs printing by causing ink droplets to be discharged from all of the nozzles included in the nozzle lines L1 to L9 of the print head 52.

(First Pass)

In the main scan of the first pass (i.e., the outgoing path OP main scan), the deposition order of the inks of the rasters corresponding to the odd-numbered nozzle lines L1, L3, L5, L7, and L9 is "KCMY". Also, the deposition order of the inks of the rasters corresponding to the even-numbered nozzle lines L2, L4, L6, and L8 is "YMCK". When the print head 52 main scan of the first pass ends, the printer 50 transfers the paper P by 9NP to the downstream side in the sub scanning direction.

(Second Pass)

In the main scan of the second pass (i.e., the returning path RP main scan), the deposition order of the inks of the rasters corresponding to the odd-numbered nozzle lines L1, L3, L5, L7 and L9 is "YMCK". Also, the deposition order of the inks of the rasters corresponding to the even-numbered nozzle lines L2, L4, L6, and L8 is "KCMY". When the second pass of the print head 52 main scan ends, the printer 50 transfers the paper P by 9NP to the downstream side in the sub scanning direction. Thereafter, the printer 50 repeatedly performs outgoing path OP main scans and returning path RP main scans in an alternating manner until the print head 52 main scan of the L-th pass ends.

As described hereinabove, in the present embodiment, when the print mode is set to the color bidirectional print mode, the PC 10 creates print data for performing color bidirectional printing using all nine of the nozzle lines L1 to L9 of the print head 52 (refer to S30 of FIG. 2). As shown in FIG. 9, the printer 50 performs color bidirectional printing in accordance with the created print data. As a result, printing is performed such that the rasters with the deposition order of "KCMY" (i.e., the rasters corresponding to the nozzle lines L1, L3, L5, L7, and L9 of the first pass, and the rasters corresponding to the nozzle lines L2, L4, L6, and L8 of the second pass in FIG. 9) and the rasters with the deposition order of "YMCK" (i.e., the rasters corresponding to the nozzle lines L2, L4, L6, and L8 of the first pass, and the rasters corresponding to the nozzle lines L1, L3, L5, L7, and L9 of the second pass in FIG. 9) are formed in an alternating manner. When color bidirectional printing is performed, no two rasters of the same deposition order are contiguous. Therefore, a situation in which, when the paper is viewed in its entirety, there is a location where it is apparent that the color difference stands out more than the other parts is less likely to occur.

Color Single Directional Printing of Embodiment 3

FIG. 10

Figure 10:
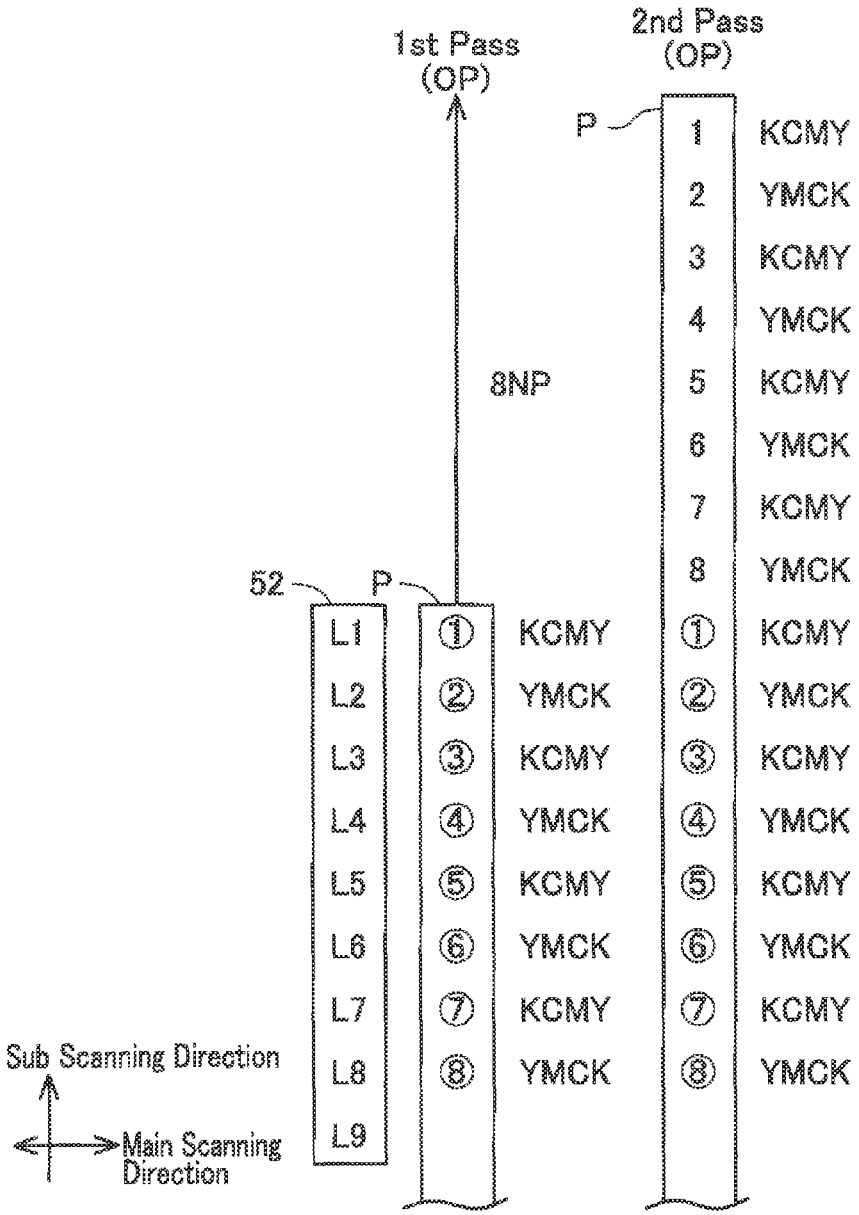
FIG. 10 shows an example of a case where color single directional printing is performed in the third embodiment.

The contents of color single directional printing of the present embodiment will be explained. The printer 50, in acquiring the print data created in S32 of FIG. 2 from the PC 10, performs the color single directional printing shown in FIG. 10 in accordance with this print data. FIG. 10 shows the printing of the first and the second passes. As described hereinabove, the pass data is for performing printing using nozzle lines L1 to L8 excluding nozzle line L9. Therefore, the printer 50 performs printing by causing ink droplets to be discharged only from the nozzles included in the eight nozzle lines L1 to L8 excluding nozzle line L9 from among the nozzle lines L1 to L9 of the print head 52.

(First Pass)

In the main scan of the first pass (i.e., the outgoing path OP main scan), the deposition order of the inks of the rasters corresponding to the odd-numbered nozzle lines L1, L3, L5, and L7 is "KCMY". Also, the deposition order of the inks of the rasters corresponding to the even-numbered nozzle lines L2, L4, L6, and L8 is "YMCK". When the first pass of the print head 52 main scan ends, the printer 50 transfers the paper P by 8NP to the downstream side in the sub scanning direction.

(Second Pass)

In the main scan of the second pass (i.e., the outgoing path OP main scan), the deposition order of the inks of the rasters corresponding to the odd-numbered nozzle lines L1, L3, L5, and L7 is "KCMY". Also, the deposition order of the inks of the rasters corresponding to the even-numbered nozzle lines L2, L4, L6, and L8 is "YMCK". When the second pass of the print head 52 main scan ends, the printer 50 transfers the paper P by 8NP to the downstream side in the sub scanning direction. Thereafter, the printer 50 repeatedly performs outgoing path OP main scans until the print head 52 main scan of the L-th pass ends.

As described hereinabove, in the present embodiment, when the print mode is set to the color single directional print mode, the PC 10 creates print data for performing color single directional printing using the eight nozzle lines L1 to L8 excluding the nozzle line L9 from among the nozzle lines L1 to L9 of the print head 52 (refer to S32 of FIG. 2). As shown in FIG. 10, the printer 50 performs color single directional printing in accordance with the created print data. As a result, printing is performed such that the rasters with the deposition order of "KCMY" (i.e., the rasters corresponding to the odd-numbered nozzle lines L1, L3, L5, and L7) and the rasters with the deposition order of "YMCK" (i.e., the rasters corresponding to the even-numbered nozzle lines L2, L4, L6, and L8) are formed in an alternating manner. When color single directional printing is performed, no two rasters of the same deposition order are contiguous. Therefore, a situation in which, when the paper is viewed in its entirety, there is a location where it is apparent that the color difference stands out more than the other parts is less likely to occur.

(Correspondence Relationship)

The print data created in S30 of FIG. 2 and the print data created in S32 of FIG. 2 are examples of "first print data", and "second print data", respectively.

Specific examples of the present invention have been explained in detail above, but these specific examples are merely illustrative, and do not limit the scope of the claims. Various modifications and changes of the specific examples illustrated above are included in the techniques disclosed in the claims. Modifications of the embodiments described hereinabove will be enumerated below.

(Modification 1) In each of the embodiments described hereinabove, when color printing is designated by the user (NO in S12 of FIG. 2), the CPU 22 changes the setting of the print mode to either the color single directional print mode or the color bidirectional print mode (S18 or S20) in accordance with whether high-quality printing was designated by the user or not (S14). Not limited to this, when color printing is designated by the user, the CPU 22 may change the setting of the print mode to either the color single directional print mode or the color bidirectional print mode in accordance with whether the user-designated paper P is fine quality paper or not. In the case of this modification, for example, when the user-designated paper P is either fine quality paper or glossy paper, the CPU 22 may set the print mode to the color single directional print mode. Alternatively, when the user-designated paper P is plain paper, the CPU 22 may set the print mode to the color bidirectional print mode. In another example of the present modification, when color printing is designated by the user, the CPU 22 may change the setting of the print mode to either the color single directional print mode or the color bidirectional print mode in accordance with whether high-quality printing was designated by the user or not and whether the user-designated paper P is fine quality paper or not.

(Modification 2) In each of the embodiments described hereinabove, when monochrome printing is designated by the user (NO in S12 of FIG. 2), the CPU 22 sets the print mode to the monochrome bidirectional print mode. The CPU 22 creates print data for causing the printer 50 to execute the monochrome bidirectional print mode (S34 of FIG. 2). Not limited to this, when monochrome printing is designated by the user, the CPU 22 may set the print mode to a monochrome single directional print mode. In another example, when monochrome printing is designated by the user, the CPU 22 may change the print mode to either the monochrome single directional print mode or the monochrome bidirectional print mode in accordance with whether high-quality printing was designated by the user or not. In the case of this example, when high-quality printing is designated by the user, the CPU 22 may set the print mode to the monochrome single directional print mode. This is because, in the case of monochrome printing, single directional printing is believed to be better suited to high-quality printing than bidirectional printing for the same reasons as in the case of color printing. In another modification, when monochrome printing is designated by the user, the CPU 22 may change the print mode to either the color single directional print mode or the color bidirectional print mode in accordance with whether high-quality printing was designated by the user or not (refer to S30 and S32 of FIG. 2). In the case of this modification, monochrome printing can be performed using each of the C, M, Y, and K colored inks.

(Modification 3) In the first embodiment described hereinabove, when the print mode is set to the color bidirectional print mode, the CPU 22 creates print data for performing color bidirectional printing using the seven nozzle lines L1 to L7 excluding the nozzle line L8 from the eight nozzle lines L1 to L8 of the print head 52. Instead, when the print mode is set to the color bidirectional print mode, the CPU 22 may create print data for performing color bidirectional printing using the seven nozzle lines L2 to L8 excluding the nozzle line L1 from among the eight nozzle lines L1 to L8 of the print head 52. In the same manner, in the third embodiment described hereinabove, when the print mode is set to the color single directional print mode, the CPU 22 may create print data for performing color single directional printing using the eight nozzle lines excluding the nozzle line L1 from among the nine nozzle lines L1 to L9 of the print head 52. In this modification, the seven nozzle lines L2 to L8, and the eight nozzle lines L2 to L9 are examples of "(K−k) groups of nozzles being nozzle groups excluding the k groups of nozzles positioned at an end on a second side of the second direction from the K groups of nozzles".

(Modification 4-1) In the first embodiment described hereinabove, when the print mode is set to the color bidirectional print mode, the CPU 22 may create print data for performing color bidirectional printing using the five nozzle lines L1 to L5 excluding the three nozzle lines L6 to L8 from the eight nozzle lines L1 to L8 of the print head 52. The five nozzle lines L1 to L5 are also examples of "(K−k) groups of nozzles being nozzle groups excluding the k groups of nozzles positioned at an end on a second side of the second direction from the K groups of nozzles".

(Modification 4-2) In the second embodiment described hereinabove, when the print mode is set to the color single directional print mode, the CPU 22 may create print data that alternately includes first pass data for causing ink to be discharged from the five nozzle lines L1 to L5 excluding the three nozzle lines L6 to L8, and second pass data for causing ink to be discharged from the five nozzle lines L4 to L8 excluding the three nozzle lines L1 to L3 from among the eight nozzle lines L1 to L8 of the print head 52. The five nozzle lines L1 to L5 are examples of "(K−k) groups of nozzles being nozzle groups excluding k groups of nozzles positioned at an end on a first side of the second direction from the K groups of nozzles". Furthermore, the five nozzle lines L4 to L8 are examples of "(K−k) groups of nozzles being nozzle groups excluding the k groups of nozzles positioned at an end on a second side of the second direction from the K groups of nozzles".

(Modification 4-3) In the third embodiment described hereinabove, when the print mode is set to the color single directional print mode, the CPU 22 may create print data for performing color single directional printing using the six nozzle lines L1 to L6 excluding the three nozzle lines L7 to L9. The six nozzle lines L1 to L6 are also examples of "(K−k) groups of nozzles being nozzle groups excluding the k groups of nozzles positioned at an end on a second side of the second direction from the K groups of nozzles".

(Modification 5) In each of the embodiments described hereinabove, the odd-numbered nozzle lines L1, L3, L5, L7 (, and L9), in which the four nozzles of the C nozzle, the M nozzle, the Y nozzle and the K nozzle are lined up in the outgoing direction in the order of the Y nozzle, the M nozzle, the C nozzle, and the K nozzle, and the even-numbered lines L2, L4, L6, and L8, in which the four nozzles are lined up in the returning direction in the order of the Y nozzle, the M nozzle, the C nozzle, and the K nozzle, are arranged alternately along the sub scanning direction in the print head 52. Not limited to this, two or more successive odd-numbered nozzle lines and two or more successive even-numbered nozzle lines may be arranged alternately along the sub scanning direction in the print head 52. In this example, the two or more successive odd-numbered nozzle lines and the two or more successive even-numbered nozzle lines are examples of "a first type of nozzle group", and "a second type of nozzle group", respectively.

(Modification 6) In each of the embodiments described hereinabove, each nozzle line is provided with four nozzles, i.e., the C nozzle, the M nozzle, the Y nozzle, and the K nozzle. The nozzles provided by each nozzle line are not limited to the four nozzles of the C nozzle, the M nozzle, the Y nozzle, and the K nozzle, and may be an arbitrary number. Generally speaking, among the N pieces of nozzles included in a first type of nozzle line, a color of ink discharged by an n-th nozzle (n being an integer equal to or more than 1 and equal to or less than N) from a first side of a first direction may be identical to a color of ink discharged by an n-th nozzle from a second side of the first direction among N nozzles included in a second type of nozzle line.

(Modification 7) In each of the embodiments described hereinabove, the CPU 22 of the PC 10 creates print data in accordance with a printer driver 26. The present invention is not limited to this, and the controller 60 of the printer 50 may create print data on the basis of the RGB image data (refer to FIG. 3). In this modification, the controller 60 of the printer 50 is an example of "a control device". A print engine provided with the print head 52, the head actuating unit 54, and the medium transferring unit 56 is an example of "a print performing unit".

(Modification 8) In each of the embodiments described hereinabove, the processing of FIG. 2 is realized by the CPU 22 of the PC 10 executing the printer driver 26 (i.e., software). Instead, at least a portion of the processing of FIG. 2 may be realized by a logical circuit or other such hardware.

What is claimed is:

1. A control device comprises:

a processor; and a memory storing computer-readable instructions therein, the computer-readable instructions, when executed by the processor, causing the control device to perform:

acquiring image data representing a target image;

creating print data by using the image data; and supplying the print data to a print performing unit, wherein the print performing unit comprises a print head configured to perform a main scanning operation of discharging ink while moving along a main scanning direction, the print head comprises K groups of nozzles (K being an integer equal to or more than 2) provided along a sub scanning direction being orthogonal to the main scanning direction, in the K groups of nozzles, a first type of nozzle group and a second type of nozzle group are alternately provided along the sub scanning direction, the first type of nozzle group comprising a first type of nozzle line including N pieces of nozzles (N being an integer equal to or more than 2) provided along the main scanning direction, the second type of nozzle group comprising a second type of nozzle line including N pieces of nozzles provided along the main scanning direction, a color of ink discharged by an n-th nozzle (n being each integer satisfying $1 \leq n < N$) from a first side of the main scanning direction among the N pieces of nozzles included in the first type of nozzle line is identical to a color of ink discharged by an n-th nozzle from a second side of the main scanning direction among the N pieces of nozzles included in the second type of nozzle line, the creating of the print data includes selecting one printing method for printing the target image on a record medium from among a plurality of printing methods including a first printing method and a second printing method, the first printing method being a printing method for performing a color printing of the target image by the print head conducting both of a first main scanning operation and a second main scanning operation, the first main scanning operation including discharging ink while moving from the first side to the second side in the main scanning direction, the second main scanning operation including discharging ink while moving from the second side to the first side in the main scanning direction, the second printing method being a printing method for performing a color printing of the target image by the print head conducting only a specific main scanning operation which is one of the first main scanning operation and the second main scanning operation, and the creating of the print data includes:

creating, in a case where one of the first printing method and the second printing method is selected, first print data for causing all of the K groups of nozzles to discharge inks of a plurality of different colors so as to perform the color printing of the target image, the first print data including main scanning direction information which indicates a direction the print head is being made to move in, and first association information which indicates a correspondence relation between a nozzle line number and a pixel line which is to be created by the corresponding nozzle line for respective K groups of nozzles; and creating, in a case where the other of the first printing method and the second printing method is selected, second print data for causing (K−k) groups of nozzles to discharge inks of a plurality of different colors so as to perform the color printing of the target image, the (K−k) groups of nozzles being nozzle groups excluding k groups of nozzles (k being an odd integer satisfying $1 \leq k < K$) from the K groups of nozzles, the k groups of nozzles being positioned at an end of the sub scanning direction, the second print data including main scanning direction information which indicates a direction the print head is being made to move in, and second association information which indicates a correspondence relation between a nozzle line number and a pixel line which is to be created by the corresponding nozzle line for respective (K−k) groups of nozzles.

2. The control device as in claim 1, wherein the K is an even integer equal to or more than 2, the creating of the print data includes:

creating the first print data in a case where the second printing method is selected; and creating the second print data in a case where the first printing method is selected.

3. The control device as in claim 2, wherein the first print data is print data for causing all of the K groups of nozzles to discharge inks of the plurality of colors in each of a plurality of times of the specific main scanning operation, and the second print data is print data for causing the (K−k) groups of nozzles to discharge inks of the plurality of colors in each of a plurality of times of the first main scanning operation and a plurality of times of the second main scanning operation.

4. The control device as in claim 2, wherein the first print data is print data for:

causing (K−k) groups of nozzles excluding k groups of nozzles positioned at an end on a first side of the sub scanning direction from the K groups of nozzles to discharge ink in the specific main scanning operation for an m-th time (m being each integer satisfying $1 \leq m < M$) among M times (M being an integer equal to and more than 2) of the specific main scanning operation; and for causing (K−k) groups of nozzles excluding k groups of nozzles positioned at an end on a second side of the second direction from the K groups of nozzles to discharge ink in the specific main scanning operation for an (m+1)-th time among the M times of the specific main scanning operation, and the second print data is print data for causing the (K−k) groups of nozzles to discharge ink in each of a plurality of times of the first main scanning operation and a plurality of times of the second main scanning operation.

5. The control device as in claim 4, wherein the first print data includes:

first transfer amount information indicating a first transfer amount for transferring the record medium along the sub scanning direction after the specific main scanning operation for the m-th time; and second transfer amount information indicating a second transfer amount for transferring the record medium along the sub scanning direction after the specific main scanning operation for the (m+1)-th time, the second transfer amount being different from the first transfer amount.

6. The control device as in claim 1, wherein the K is an odd integer equal to or more than 3, and the creating of the print data includes:

creating the first print data in a case where the first printing method is selected; and creating the second print data in a case where the second printing method is selected.

7. The control device as in claim 1, wherein the computer-readable instructions, when executed by the processor, cause the control device to further perform:

acquiring quality information indicating a printing quality of the target image, and the selecting includes:

selecting the second printing method in a case where the quality information indicates high quality; and selecting the first printing method in a case where the quality information indicates low quality.

8. The control device as in claim 1, wherein the N pieces of nozzles included in the first type of nozzle line include a nozzle for discharging an achromatic ink, the N pieces of nozzles included in the second type of nozzle line include a nozzle for discharging the achromatic ink, the plurality of printing methods further includes a third printing method for performing a monochrome printing of the target image by the print head conducting a third main scanning operation including discharging only the achromatic ink while moving along the main scanning direction, and the creating of the print data includes creating, in a case where the third printing method is selected, third print data for causing all of the K groups of nozzles to discharge the achromatic ink so as to perform the monochrome printing of the target image.

9. The control device as in claim 1, wherein the first type of nozzle group comprises only one line of the first type of nozzle line, and the second type of nozzle group comprises only one line of the second type of nozzle line.

10. A non-transitory computer-readable medium storing computer-readable instructions for a control device the computer-readable instructions, when executed by a processor mounted on the control device, cause the control device to perform:

acquiring image data representing an target image;

creating print data by using the image data; and supplying the print data to a print performing unit, wherein the print performing unit comprises a print head configured to perform a main scanning operation of discharging ink while moving along a main scanning direction, the print head comprises K groups of nozzles (K being an integer equal to or more than 2) provided along a sub scanning direction being orthogonal to the main scanning direction, in the K groups of nozzles, a first type of nozzle group and a second type of nozzle group are alternately provided along the sub scanning direction, the first type of nozzle group comprising a first type of nozzle line including N pieces of nozzles (N being an integer equal to or more than 2) provided along the main scanning direction, the second type of nozzle group comprising a second type of nozzle line including N pieces of nozzles provided along the main scanning direction, a color of ink discharged by an n-th nozzle (n being each integer satisfying $1 \leq n < N$) from a first side of the main scanning direction among the N pieces of nozzles included in the first type of nozzle line is identical to a color of ink discharged by an n-th nozzle from a second side of the main scanning direction among the N pieces of nozzles included in the second type of nozzle line, the creating of the print data includes selecting one printing method for printing the target image on a record medium from among a plurality of printing methods including a first printing method and a second printing method, the first printing method being a printing method for performing a color printing of the target image by the print head conducting both of a first main scanning operation and a second main scanning operation, the first main scanning operation including discharging ink while moving from the first side to the second side in the main scanning direction, the second main scanning operation including discharging ink while moving from the second side to the first side in the main scanning direction, the second printing method being a printing method for performing a color printing of the target image by the print head conducting only a specific main scanning operation which is one of the first main scanning operation and the second main scanning operation, and the creating of the print data includes:

creating, in a case where one of the first printing method and the second printing method is selected, first print data for causing all of the K groups of nozzles to discharge inks of a plurality of different colors so as to perform the color printing of the target image, the first print data including main scanning direction information which indicates a direction the print head is being made to move in, and first association information which indicates a correspondence relation between a nozzle line number and a pixel line which is to be created by the corresponding nozzle line for respective K groups of nozzles; and creating, in a case where the other of the first printing method and the second printing method is selected, second print data for causing (K−k) groups of nozzle s to discharge inks of a plurality of different colors so as to perform the color printing of the target image, the (K−k) groups of nozzles being nozzle groups excluding k groups of nozzles (k being an odd integer satisfying $1 \leq k < K$) from the K groups of nozzles, the k groups of nozzles being positioned at an end of the sub scanning direction, the second print data including main scanning direction information which indicates a direction the print head is being made to move in, and second association information which indicates a correspondence relation between a nozzle line number and a pixel line which is to be created by the corresponding nozzle line for respective (K−k) groups of nozzles.

11. A control device comprises:

a processor; and a memory storing computer-readable instructions therein, the computer-readable instructions, when executed by the processor, causing the control device to perform:

acquiring image data representing a target image;

creating print data by using the image data; and supplying the print data to a print performing unit, wherein the print performing unit comprises a print head configured to perform a main scanning operation of discharging ink while moving along a main scanning direction, the print head comprises a first plurality of nozzles in a first row and a second plurality of nozzles in a second row, the first row and the second row arranged in the main scanning direction, and the second row being sequential to the first row in a sub scanning direction orthogonal to the main scanning direction;

the nozzles in the first row are configured to discharge inks of a plurality of different colors in a first color sequence; and the nozzles in the second row are configured to discharge inks of the plurality of different colors in a second color sequence, the second color sequence being in an opposite order as compared to the first color sequence, and the creating of the print data includes selecting one printing method for printing the target image on a record medium from among a plurality of printing methods including a first printing method and a second printing method, the first printing method being a printing method for performing a color printing of the target image by the print head conducting both of a first main scanning operation and a second main scanning operation, the first main scanning operation including discharging ink while moving from the first side to the second side in the main scanning direction, the second main scanning operation including discharging ink while moving from the second side to the first side in the main scanning direction, the second printing method being a printing method for performing a color printing of the target image by the print head conducting only a specific main scanning operation which is one of the first main scanning operation and the second main scanning operation, and the creating of the print data includes:

creating, in a case where one of the first printing method and the second printing method is selected, first print data for causing all of the K groups of nozzles to discharge inks of a plurality of different colors so as to perform the color printing of the target image, the first print data including main scanning direction information which indicates a direction the print head is being made to move in, and first association information which indicates a correspondence relation a nozzle line number and a pixel line which is to be created by the corresponding nozzle line for respective K groups of nozzles; and creating, in a case where the other of the first printing method and the second printing method is selected, second print data for causing (K−k) groups of nozzles to discharge inks of a plurality of different colors so as to perform the color printing of the target image, the (K−k) groups of nozzles being nozzle groups excluding k groups of nozzles (k being an odd integer satisfying $1 \leq k < K$) from the K groups of nozzles, the k groups of nozzles being positioned at an end of the sub scanning direction, the second print data including main scanning direction information which indicates a direction the print head is being made to move in, and second association information which indicates a correspondence relation between a nozzle line number and a pixel line which is to be created by the corresponding nozzle line for respective (K−k) groups of nozzles.

* * * * *